United States Patent [19]

Ueda et al.

[11] Patent Number: 4,979,868

[45] Date of Patent: Dec. 25, 1990

[54] METHOD OF GRIPPING CORNER OF STRIP OF CLOTH

[75] Inventors: Atsushi Ueda; Hidetoshi Ishihara; Kunio Kojima, all of Nagoya, Japan

[73] Assignees: Mitsubishi Jukogyo Kabushiki Kaisha; Churyo Engineering Kabushiki Kaisha, both of Tokyo, Japan

[21] Appl. No.: 427,991

[22] Filed: Oct. 27, 1989

Related U.S. Application Data

[63] Continuation of Ser. No. 52,428, May 21, 1987, abandoned.

[30] Foreign Application Priority Data

| | | | |
|---|---|---|---|
| Dec. 1, 1986 | [JP] | Japan | 61-286503 |
| Dec. 1, 1986 | [JP] | Japan | 61-286504 |
| Mar. 19, 1987 | [JP] | Japan | 62-65041 |

[51] Int. Cl.[5] ..... D06F 67/04

[52] U.S. Cl. ..... 414/786; 38/12; 38/143; 414/13

[58] Field of Search ..... 38/2, 7, 8, 12, 102, 38/143, 144; 198/465.4; 414/13, 786

[56] References Cited

U.S. PATENT DOCUMENTS

| | | | |
|---|---|---|---|
| 1,732,278 | 10/1929 | Presher | 38/8 |
| 3,092,263 | 6/1963 | Beaudry et al. | 414/13 |
| 3,092,271 | 6/1963 | Beaudry et al. | 414/786 |
| 3,696,942 | 10/1972 | Kitchener et al. | 414/13 |
| 4,313,269 | 2/1982 | van Rumpt et al. | 38/143 |
| 4,774,505 | 9/1988 | Ueda et al. | 38/7 X |

FOREIGN PATENT DOCUMENTS

| | | | |
|---|---|---|---|
| 2336510 | 12/1976 | France . | |
| 58-22240 | 2/1983 | Japan . | |
| 59-24685 | 2/1984 | Japan . | |
| 62-11100 | 9/1987 | Japan | 38/143 |
| 1556077 | 11/1979 | United Kingdom . | |

*Primary Examiner*—Robert J. Spar
*Assistant Examiner*—Janice Krizek
*Attorney, Agent, or Firm*—Bernard, Rothwell & Brown

[57] ABSTRACT

A method of gripping corners of a strip of cloth, which may be applied to, for example, systems for spreading strips of cloth, including a first step of suspending a rectangular strip of cloth by gripping one corner thereof, a second step of gripping the lowermost corner portion of the strip suspended in the first step, a third step of raising substantially vertically either one of the gripped points of the strip gripped in the first and second steps, a fourth step of applying braking force to the other gripping point in order to apply tension to the strip, and a fifth step of holding substantially horizontally one side of the strip having a corner portion which is adjacent to the gripped points and gripping the corner portion of the strip which is adjacent to the gripped points of the strip gripped in the first and second steps, respectively. The method enables a strip of cloth discharged from a drier to be automatically spread, thus relieving operators from the operation in the inferior environment and automating the operation in laundry works. Also disclosed is an apparatus which may suitably be employed to carry out the above-described method.

3 Claims, 29 Drawing Sheets

METHOD OF GRIPPING CORNER OF STRIP OF CLOTH

This is a continuation of application Ser. No. 052,428, filed May 21, 1987, abandoned.

BACKGROUND OF THE INVENTION

1. Field of the Invention

The present invention relates to a method of and apparatus for gripping corners of strips of cloth which may be applied to, for example, systems for spreading strips of cloth, systems for sorting linens or other textile products, and systems for spreading linens or the like before they are washed.

2. Description of the Related Art

Generally speaking, in laundry works, received goods such as sheets, towels and wrapping cloth (hereinafter referred to as "strips of cloth") are washed in a continuous washing machine or the like and then dewatered before being cast into a drier. Strips of cloth which have been subjected to the drying process are disentangled and spread. Then, the strips of cloth are ironed and folded for forwarding. In this series of processes, between the drying process and the ironing process, strips of cloth taken out of the drier are transported to a predetermined place by means of a belt conveyor, and five to six operators take out strips, one by one, from a mass of cloth which is stacked, and they spread the strips of cloth and feed them to an ironing device or an auxiliary device thereof (e.g., a spreader, a feeder, etc.).

Spreading of strips of cloth finished with the drying process involves an operation conducted in an atmosphere of high temperature and humidity, which means that the operators suffer from heavy labor in the inferior environment In these circumstances, it has heretofore been demanded to develop an apparatus which enables automation of the operation of spreading strips of cloth. However, such automated apparatus is not present in the art, and there is only one related art which is a method of holding a strip of cloth in a fixed position disclosed in Japanese Patent Publication No. 59 24685 (1984).

This prior art method comprises: a first step of suspending a strip of cloth by holding one portion thereof: a second step of holding the lowermost corner portion of the strip suspended in the first step and releasing the strip from the hold made in the first step; a third step of holding the lowermost end portion of the strip suspended in the second step; and a fourth step of stretching the strip while holding substantially horizontal the section of the strip between the two points held in the second and third steps. For the case of a rectangular strip of cloth, the following description is set forth in the specification of the prior art.

Namely, when, in the first step, a rectangular strip S of cloth is suspended by holding it at any one point, the straight line which intersects the held point 27 and the center of gravity 28 is vertical as shown in FIG. 42. When, in the second step, the lowermost corner 29 of the strip S in this state is held to suspend the strip S and further the strip S is released from the hold made in the first step, the distance between the upper and lower corners 29 and 30 is constant as shown in FIG. 43. Therefore, in the third step the lower corner 30 of the strip S as viewed in FIG. 43 is held. Then, in the fourth step, the upper and lower corners 29 and 30 which are points held in the second and third steps, respectively, are held so that the section between these points is substantially horizontal as shown in FIG. 44. Thus, the strip S is held in a fixed position and may be transferred to a subsequent process. To hold the strip S in a spread state, either one of the lower corners 31 and 32 shown in FIG. 44 is held in the fifth step.

FIG. 45 is a front view of an apparatus for holding a strip of cloth in a fixed position which may be employed to carry out the above-described method. For the convenience of description, the apparatus is divided into four sections A to D. The apparatus is arranged as follows. In the section A, a strip of cloth is held and one corner of the strip which is held is detected; in the section B, a corner opposing the corner held in the section A is detected; in the sections B and C, the strip which is held at opposing corners thereof is held so that the diagonal line is horizontal, and either one of the corners which define the lower ends and which overlap each other is held; and in the sections C and D, corners of the strips which are adjacent to each other are held and the strip is thus held in a fixed position. In the figures, a squeezing rod 70 is provided in the vicinity of the extremity of the rightward movement of a chuck 68 in such a manner that the rod 70 is vertically movable along a guide slot 71.

A chuck 72 is provided below the extremity of the rightward movement of the chuck 68 in such a manner that the chuck 72 is vertically movable along a guide slot 73 and also movable rightwardly upward from its top dead center. A squeezing rod 74 is provided in the vicinity of the top dead center of the obliquely vertical movement of the chuck 72 in such a manner that the rod 74 is vertically movable along a guide slot 75. A chuck 76 is provided in such a manner as to be movable in the obliquely vertical direction, the bottom dead center of the chuck 76 being set below the top dead center of the obliquely vertical movement of the chuck 72. A chuck 78 is provided in such a manner as to move vertically along a guide slot 79 below the medium point of the line which intersects the respective top dead centers of the obliquely vertical movements of the chucks 72 and 76 and further in such a manner that the chuck 78 moves in the obliquely vertical direction with its top dead center defined as the bottom dead center of its obliquely vertical movement It should be noted that the chucks 68, 72, 76, 78 and the squeezing rods 70 and 74 are driven by means of air cylinders (not shown) so as to move along the respective guide slots.

With this apparatus, a rectangular strip of cloth is held in a fixed position according to the following procedure. Referring first to FIG. 46, a portion of a strip 80 of cloth which is to be held in a fixed position is detected and held by the chuck 68, and the chuck 68 rises along the guide slot 69 and then moves rightward, thus bringing the strip 80 into the state shown in FIG. 47. Referring to FIG. 47, the strip 80 which is suspended from the chuck 68, since its lowermost corner is not necessarily disposed directly above the chuck 72, is squeezed with the squeezing rod 70, which is circular and has a notch in part thereof, so that the lowermost corner of the strip 80 comes directly above the chuck 72 located directly below the chuck 68. Thereupon, the chuck 72 moves upward and holds one of the corners of the rectangle which defines the lowermost corner of the strip 80 as shown in FIG. 48. Thereafter, the chuck 68 releases the strip 80, and the chuck 72 moves downward and further moves rightwardly upward along the guide slot 73. At this time the squeezing rod 70 returns to the top dead center of the guide slot 71.

Referring to FIG. 49, the strip 80 which is suspended from the chuck 72 and which has reached the top dead center of the guide slot 73 and faces downward is squeezed with the squeezing rod 74. In consequence, the lowermost corner (the corner opposing the corner held by the chuck 72) of the strip 80 comes to the position of the chuck 76 (a fixed position determined in accordance with the size of the strip 80) and therefore is detected and held by the chuck 76. The chuck 76 holding the lowermost corner of the strip 80 rises along the guide slot 77 to the top dead center, so that the two opposing corners of the strip 80 are held horizontal by means of the chucks 72 and 76 as shown in FIG. 50. At this time, the squeezing rod 74 returns to the top dead center of the guide slot 75.

Referring next to FIG. 50, the strip 80 is held by the chucks 72 and 76 so that the two opposing corners are horizontal. Then, the strip 80 can be held in a fixed position in such a manner that its adjacent corner is held by providing a chuck 81 corresponding to the chuck 76 at the position of either one of the two suspended corners of the strip 80, holding said suspended corner with the chuck 81, opening the chuck 72, and holding the strip 80 with the chucks 76 and 81. It should be noted that, since in this apparatus the distance between the right upper end position of the chuck 72 and the left bottom end position of the chuck 76 is set so as to be substantially equal to the length of the diagonal line of strips which are to be handled, when the chuck 72 holds two corners of the strip 80 which are adjacent to each other in the step shown in FIG. 48, the chuck 76 cannot hold the strip 80, and therefore the strip 80 must try to be held again.

The apparatus for gripping a strip of cloth which is employed in the above-described conventional apparatus has the following problems.

Namely, since the chucks 72, 76 and 81 are located in their respective fixed positions, it is only possible to spread rectangular strips of cloth having specific dimensions, and therefore the apparatus is not practical with respect to strips of cloth having diverse dimensions.

Further, since the chuck 72 cannot move from its fixed position before the chuck 81 holds the strip 80 of cloth, it is necessary in order to spread the strip 80 at high speed to provide a plurality of apparatuses of the same arrangement, which means that the spreading ability is disadvantageously low.

SUMMARY OF THE INVENTION

In view of the above-described problems of the prior art, it is a primary object of the present invention to provide a method of gripping corners of a strip of cloth which enables a strip discharged from a drier to be automatically spread, thus relieving operators from the operation in the inferior environment and automating the operation in laundry works, together with an apparatus which may suitably be employed to carry out said method.

To this end, according to one aspect of the present invention, there is provided a method of gripping corners of a strip of cloth comprising: a first step of suspending a rectangular strip of cloth by gripping one corner thereof; a second step of gripping the lowermost corner portion of the strip suspended in the first step; a third step of raising substantially vertically either one of the gripped points of the strip gripped in the first and second steps; a fourth step of applying braking force to the other gripped point in order to apply tension to the strip; and a fifth step of holding substantially horizontally one side of the strip having a corner portion which is adjacent to the gripped points, and gripping the corner portion of the strip which is adjacent to the gripped points of the strip gripped in the first and second steps, respectively.

According to another aspect of the present invention, there is provided an apparatus for gripping corners of a strip of cloth comprising: a first chuck conveyor for suspending a rectangular strip of cloth by gripping one corner thereof; a second chuck conveyor for gripping the lowermost corner of the strip being suspended by the first chuck conveyor, the second chuck conveyor being disposed so as to be capable of holding one side of the strip substantially horizontal; drive means for raising substantially vertically either one of the gripped points gripped by the first and second chuck conveyors, respectively; chuck braking means for applying braking force to the other gripped point; and a third chuck conveyor for gripping a corner portion of the strip which is adjacent to the points gripped by the first and second chuck conveyors.

According to still another aspect of the present invention, there is provided a method of gripping corners of a strip of cloth comprising the steps of: gripping the strip of cloth at any point thereof with a chuck; transporting the chuck by means of a conveyor, and while doing so, squeezing the strip by squeezing means in a slanted state to detect a corner portion of the strip; arranging empty chucks successively fed so as to stand by in such a manner as to be able to grip the strip; and closing one of the empty chucks so as to grip the detected corner portion of the strip in response to a signal indicating the passage of the corner of the strip.

According to a further aspect of the present invention, there is provided an apparatus of gripping corner of a strip of cloth comprising: means for conveying a chuck gripping the strip of cloth at any point thereof; means for squeezing the strip with squeezing means in a slanted state to detect a corner portion of the strip; and means for successively feeding empty chucks for gripping corner of strips and opening one of the empty chucks so as to be able to grip the strip.

According to a still further aspect of the present invention, there is provided a method of gripping corners of a strip of cloth comprising the steps of: suspending a rectangular strip of cloth by gripping one corner thereof with a chuck; transporting the chuck by means of a conveyor, and while doing so, applying vibrations to the strip to thereby disentangle a short side from the strip; squeezing the strip with squeezing means to detect a lowermost corner portion thereof; and gripping the detected corner with one of the empty chucks fed successively.

According to a still further aspect of the present invention, there is provided an apparatus for gripping corners of a strip of cloth comprising: means for transporting a chuck gripping one corner of a rectangular strip of cloth by means of a conveyor; means for vibrating the strip to disentangle a short side of the strip therefrom; means for squeezing the strip with squeezing means to detect the trailing corner; and means for successively feeding empty chucks for gripping corner of strips and thus gripping the detected corner of the strip with one of the empty chucks.

The above and other objects, features and advantages of the present invention will become more apparent from the following description of the preferred embodiments thereof taken in conjunction with the accompanying drawings.

BRIEF DESCRIPTION OF THE DRAWINGS

FIGS. 1 to 26 show in combination a first embodiment of the present invention, in which:

FIGS. 1 and 2 are flow sheets each showing a cloth spreading system which is provided with an apparatus for gripping corners of a strip of cloth in accordance with the first embodiment;

FIG. 3(*a*) is a plan view of belt conveyors in the pick-up means shown in FIG. 1;

FIG. 3(*b*) is a side view of the belt conveyors shown in FIG. 3(*a*);

FIG. 4(*a*) is a front view of a chuck employed in the systems shown in FIGS. 1 and 2;

FIG. 4(*b*) is a sectional side view of the chuck shown in FIG. 4(*a*);

FIG. 5 is a perspective view of a squeezing means;

FIGS. 6 to 15 illustrate in combination a method of spreading a strip of cloth according to the present invention;

FIG. 16 is a detailed perspective view of an apparatus for gripping corners of a strip of cloth in accordance with the first embodiment of the present invention;

FIG. 17(*a*) to 17(*d*) are side views of the gripping apparatus in different operative states;

FIGS. 18(*a*) and 18(*b*) show in combination an empty chuck feeder in accordance with the first embodiment of the present invention, FIG. 18(*a*) showing the chuck feeder as viewed in the direction of the arrow K in FIG. 16, and FIG. 18(*b*) being a sectional view taken along the line L—L in FIG. 18(*a*);

FIG. 19 is a side view of a chuck feed and turn means in accordance with the first embodiment of the present invention;

FIG. 20 is a plan view of an unwrinkling mechanism (air blow type) for unwrinkling the periphery of corner portions of a strip of cloth;

FIG. 21 is a plan view of an unwrinkling mechanism (brush type);

FIG. 22 shows the gripping apparatus as viewed in the direction of the arrow N in FIG. 16;

FIG. 23 is a side view showing a state of a strip of cloth in the case where the chuck has no braking means;

FIG. 24(*a*) is a sectional side view of one example of a chuck braking means (spring loaded type);

FIG. 24(*b*) is a sectional view taken along the line P—P in FIG. 24(*a*);

FIG. 24(*c*) is a sectional view taken along the line Q—Q in FIG. 24(*a*);

FIG. 25(*a*) is a plan view of one example of a chuck braking means (balance weight type);

FIG. 25(*b*) is a side view of the chuck braking means shown in FIG. 25(*a*); and FIG. 26 is a sectional view taken along the line R—R in FIG. 25(*b*).

FIGS. 27 to 29 show in combination a second embodiment of the present invention, in which:

FIG. 27(*a*) is a plan view of an apparatus for gripping corners of a strip of cloth having a squeezing means in accordance with the second embodiment;

FIG. 27(*b*) is a side view of the gripping apparatus shown in FIG. 27(*a*);

FIG. 27(*c*) is a perspective view of the gripping apparatus shown in FIG. 27(*a*);

FIG. 28(*a*) is a side view of a chuck feeder in accordance with the second embodiment;

FIG. 28(*b*) is a plan view of the chuck feeder shown in FIG. 28(*a*); and FIG. 29 is a sectional view taken along the line K′—K′ in FIG. 27(*b*).

FIGS. 30 to 32 show in combination a third embodiment of the present invention, in which:

FIGS. 30 and 31 are flow sheets each showing the way in which a strip of cloth is spread in accordance with the third embodiment;

FIG. 32(*a*) is a side view of an apparatus for gripping corners of a strip of cloth in accordance with the third embodiment;

FIG. 32(*b*) is a perspective view of the vibrating roll; and

FIG. 32(*c*) is a side view showing the way in which a strip of cloth is handled in a gripping apparatus including no vibrating roll.

FIGS. 33 to 40 show in combination a means which can be employed in the embodiments of the present invention in the part denoted by A in FIG. 1 to hold a strip of cloth by suction and then grip it by means of a chuck, in which:

FIG. 33 shows the arrangement of a cloth pick-up means to which a cloth strip gripping means is applied;

FIG. 34 is a sectional view taken along the line I—I in FIG. 33;

FIG. 35 shows an arm lifting mechanism in the cloth pick-up means;

FIG. 36 is a sectional view showing the arrangement of the arm portion fixing side in the cloth strip gripping means;

FIG. 37 is a front view of the gripping mechanism side in the cloth strip gripping means;

FIG. 38 shows the gripping mechanism as viewed in the direction of the arrows II in FIG. 37;

FIGS. 39 and 40 are sectional views taken along the line III—III in FIG. 38, FIG. 39 showing a strip of cloth in a suction-hold state, and FIG. 40 showing the strip in a gripped state;

FIGS. 42 to 44 illustrate a conventional method of gripping ends of a strip of cloth;

FIG. 45 is a front view of one example of a conventional apparatus for gripping a strip of cloth in a fixed position; and FIGS. 46 to 50 are front views of the conventional apparatus shown in FIG. 45, illustrating the operation procedure thereof

DESCRIPTION OF THE PREFERRED EMBODIMENTS

Figure 1:
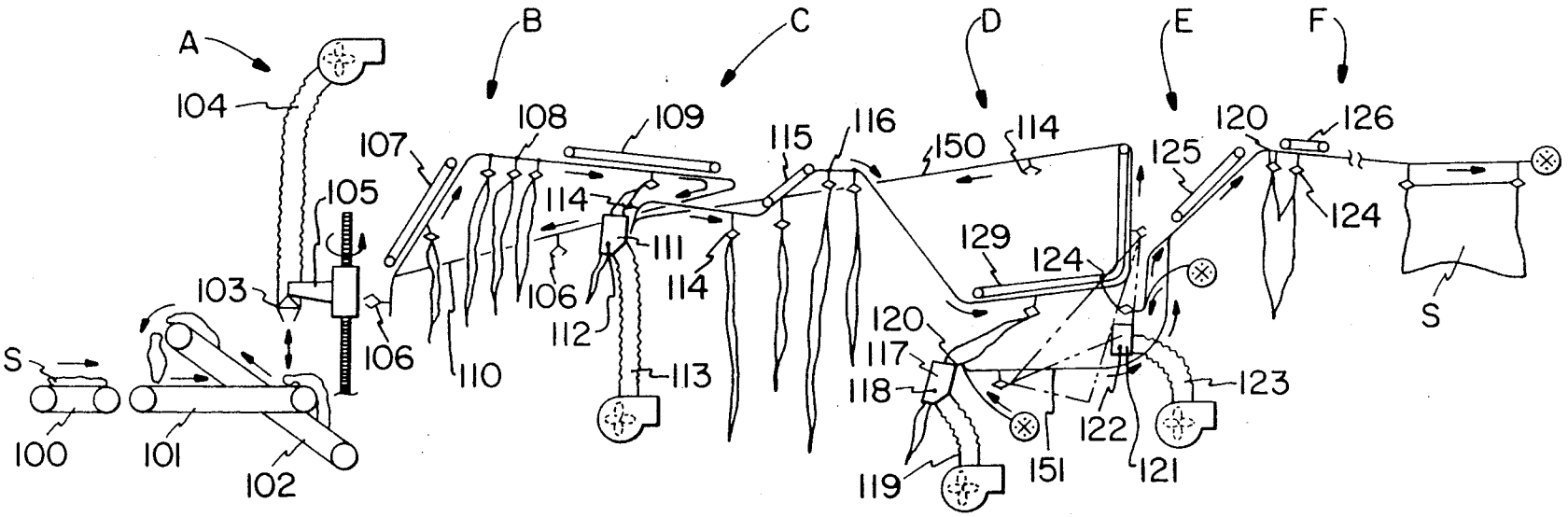
Figure 2:
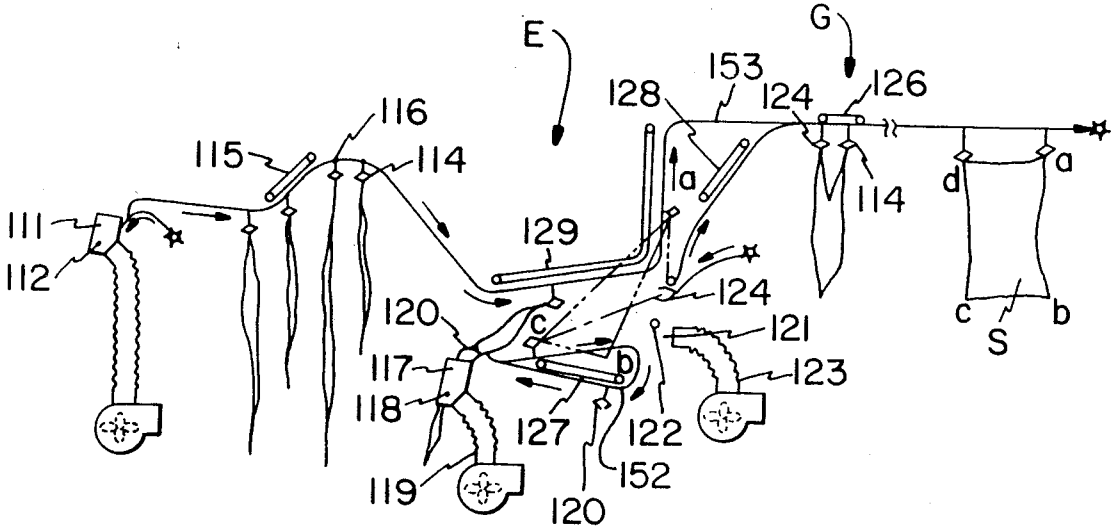

The present invention will be described hereinunder in detail by way of one embodiment and with reference to the accompanying drawings FIGS. 1 and 2 show in combination one example of a cloth spreading system to which the cloth strip gripping apparatus according to the present invention is applied FIG. 1 shows an arrangement which is adapted for spreading a rectangular strip of cloth in the direction of its long sides, while FIG. 2 shows an arrangement adapted for spreading a rectangular strip of cloth in the direction of its short sides. It should be noted that FIG. 2 illustrates only portions which are different in arrangement from those shown in FIG. 1 and the portions which are common to each other are not shown in FIG. 2.

Figure 3A:
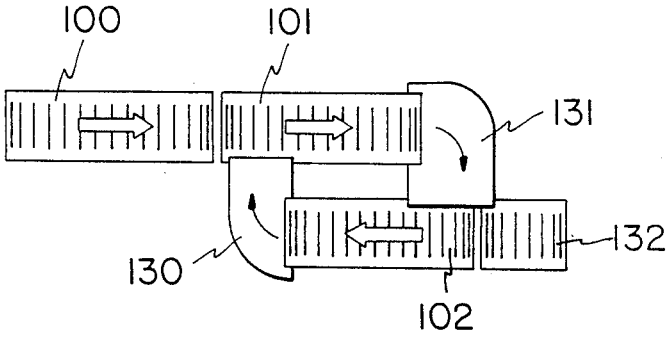
Figure 3B:
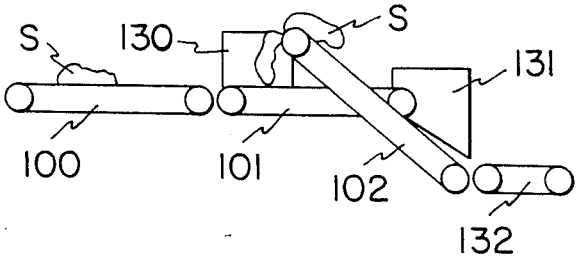

Referring to FIG. 1, the reference numeral 100 denotes a belt conveyor for conveying a rectangular strip S of cloth discharged from a drier (not shown) to this system, and the numerals 101 and 102 denote belt conveyors for receiving the strip S from the belt conveyor 100 and circulating it therethrough. These belt conveyors 100, 101 and 102 are disposed as shown in FIGS. 3(*a*) and 3(*b*), and the belt conveyors 101 and 102, together with slide plates 130 and 131, define a circulating passage. It should be noted that a belt conveyor 132 is provided for collecting any strip of cloth which fails to be spread. The reference symbol A in FIG. 1 denotes a pick-up means arranged to suck the strip S of cloth moved on the belt conveyors 101 and 102 by an air vacuum means 104 and to mechanically retain the strip S of cloth by means of a chuck 103. The pick-up means A includes a transfer means 105 arranged to raise the chuck 103 gripping the strip S of cloth and to transfer the strip S of cloth to a first chuck conveyor B.

The first chuck conveyor B receives the strip S of cloth from the pick-up means A and transports the strip S to a second chuck conveyor C in such a manner that the strip S of cloth is retained by and suspended from a chuck 106. The chuck 106 gripping the strip S of cloth is moved along a rail 110 by the operation of drive means 107 and 109. In the second chuck conveyor C, the strip S of cloth which is received from the first chuck conveyor B is squeezed by a squeezing means 111, and while doing so, the lowermost corner portion of the strip S is detected by a photoelectric sensor or the like 112. The lowermost corner portion of the strip S is gripped by means of a chuck 114, and the strip S of cloth is then transported to a third chuck conveyor D while being suspended from the chuck 114. The chuck 114 gripping the strip S is moved along a rail 150 by the operation of drive means 115 and 129.

In the third chuck conveyor D, the strip S of cloth which is received from the second chuck conveyor C is squeezed by a squeezing means 117, and while doing so, the lowermost corner portion of the strip S is detected by a photoelectric sensor 118 or the like, and the lowermost corner portion of the strip S is gripped by means of a chuck 120. The chuck 120 gripping the strip S is pulled by the chuck 114 through the strip S and, in this state, the chuck 120 moves along a rail 151 which extends through fourth and fifth chuck conveyors E and F. It should be noted that the chuck 114 in the second chuck conveyor C rises substantially vertically immediately before the fourth chuck conveyor E.

In the fourth chuck conveyor E, a corner portion (which is adjacent to the point which is gripped by the chuck 120) of the strip S of cloth which has been transported through the second and third chuck conveyors C and D is detected by means of a photoelectric sensor or the like 122, and the detected corner portion is gripped by a chuck 124. The chuck 124 gripping the strip S is conveyed to either the fifth chuck conveyor F or a sixth chuck conveyor G by the operation of a drive means 125. The fifth and sixth chuck conveyors F and G are arranged such as to receive the strip S of cloth from the fourth chuck conveyor E and convey it to a subsequent process (the ironing process) by the operation of a drive means 126 in such a manner that corner portions of the strip S which are adjacent to each other are gripped by means of chucks as illustrated. In the arrangement shown in FIG. 1, which is adapted for spreading the strip S in the direction of its long sides, the strip S is gripped by the chucks 120 and 124. In the arrangement shown in FIG. 2, which is adapted for spreading the strip S in the direction of its short sides, the strip S is gripped by the chucks 114 and 124. It should be noted that in the figures the reference numerals 108, 116 denote intermittent feed means which temporarily suspend the feed of the chucks 106, 114 in order to untwist the suspended strips S of cloth and the numerals 113, 119 and 123 denote air suction means for the squeezing means 111, 117 and a corner gripping apparatus 121.

Figure 4A:
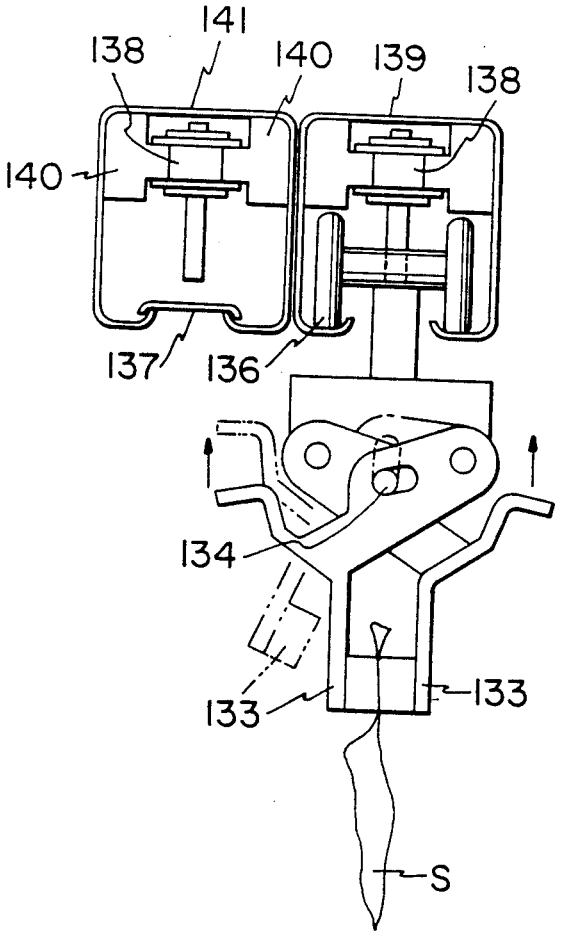
Figure 4B:
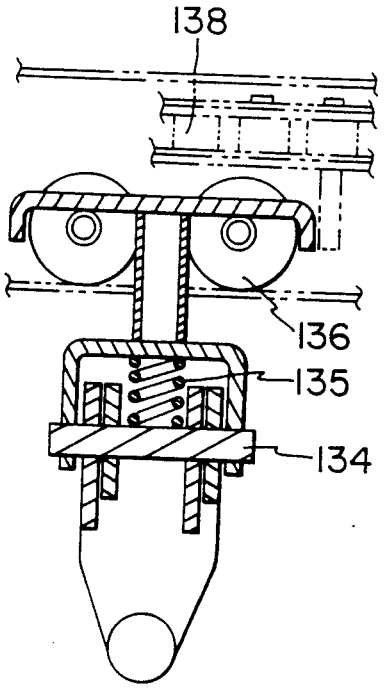

FIGS. 4(*a*) and 4(*b*) show in combination one example of the chucks 106, 114, 120 and 124. FIG. 4(*a*) is a front view of a chuck, and FIG. 4(*b*) is a sectional side view of the chuck shown in FIG. 4(*a*). In the figures, each of the chucks 106, 114, 120 and 124 has a structure in which a pin 134 is constantly pushed downward by the resilient force from a spring 135 to thereby cause levers 133 to clamp a strip S of cloth. When the upper end side portions of the levers 133 are pushed by means of external forces in the direction of the arrows shown in FIG. 4(*a*), the levers 133 are pivoted about the pin 134 as shown by the two-dot chain line to unclamp the strip S. Each of the chucks 106, 114, 120 and 124 moves along a guide rail 139 on rollers 136 which travel within the guide rail 139. The force for driving the chuck is transmitted through a chain 138 as illustrated. It should be noted that, if the guide rail 139 faces downward, each of the chucks 106, 114, 120 and 124 can move by gravity without the aid of the chain 138. In the figures, the reference numeral 137 denotes a cover, 140 a resin rail for guiding the rollers 136 and the chain 138, and 141 a guide rail for the return passage of the chain 138.

Figure 5:
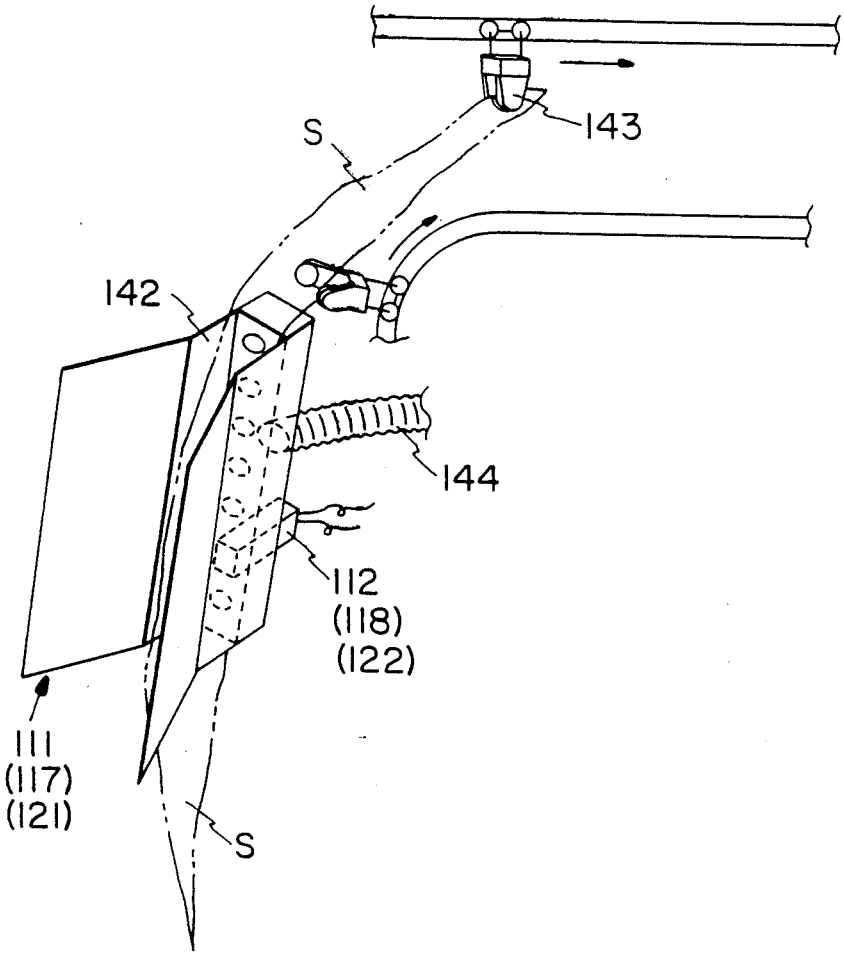
Figure 6:
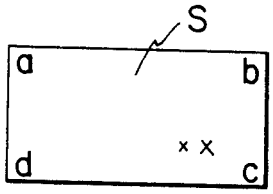

FIG. 5 shows the structure of the squeezing means 111, 117 and 121 in which a strip S of cloth is led into a squeezing groove 142 and pulled in the direction of the arrow in the figure by means of a chuck 143 (corresponding to the chucks 106 and 114 in FIG. 1), and while doing so, the strip S is sucked by an air suction means 144 (corresponding to the air suction means 113 and 119 in FIG. 1), thus squeezing the lower half of the strip S.

The method of spreading a strip of cloth according to the present invention will next be explained with reference to FIGS. 6 to 15.

Figure 7:
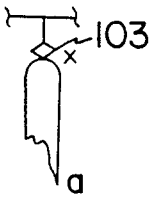
Figure 8:
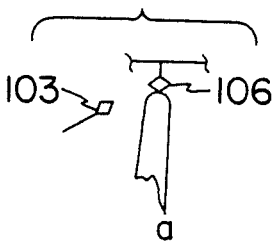
Figure 9:
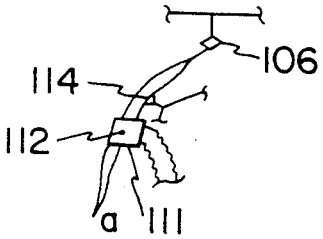
Figure 10:
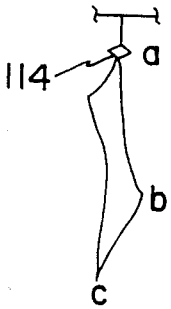

First, a mass of strips of cloth flowing on the belt conveyor 100 is led to the circulating passage which is defined by the belt conveyor 101, the slide plate 131, the belt conveyor 102 and the slide plate 130. In this case, there is a difference in level between the belt conveyor 102 and the slide plate 130, and therefore the strips S of cloth, when transferred from the former to the latter, are naturally disentangled and stacked in the circulating passage. Then, one of the strips S of cloth stacked on the belt conveyor 101 or on any place is picked up by means of the chuck 103 of the pick-up means A at any point X of the strip S as shown in FIG. 7, and the picked up strip S is then transferred to the first chuck conveyor B, where the strip S of cloth which has been picked up by the chuck 103 is gripped at the same point X by means of the chuck 106 in place of the chuck 103 as shown in FIG. 8 and then untwisted by the intermittent feed means 108 before being led into the squeezing groove of the squeezing means 111 as shown in FIG. 9. In the squeezing means 111, the lower half of the strip S of cloth is squeezed while the strip S is being pulled by the action of the traveling chuck 106, and the lowermost corner portion (the corner a) of the strip S is detected by the sensor 112. Then, the corner a of the strip S is gripped by the chuck 114 as shown in FIG. 10. The strip S is released from the hold by the chuck 106 and gripped by the chuck 114 only, and then the strip S is transported to the third chuck conveyor D while the strip S is being untwisted by the operation of the intermittent feed means 116.

Figure 11:
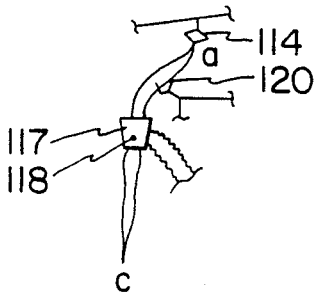
Figure 12:
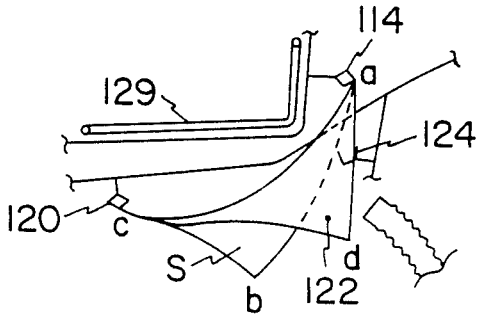

In the third chuck conveyor D, as shown in FIG. 11, the lower half of the strip S of cloth is squeezed by the squeezing means 117, and while doing so, the lowermost corner portion (the corner c) is detected by the sensor 118, and the corner c of the strip S is then gripped by the chuck 120. The chuck 120 gripping the corner c of the strip S moves along the rail 151 while being pulled through the strip S by the chuck 114 which is being moved by the operation of the drive means 129. The chuck 114 rises substantially vertically immediately before the fourth chuck conveyor E, so that the short side portion of the strip S between the corners a and d approaches the open chucking portion of the chuck 124 as shown in FIG. 12.

Figure 13:
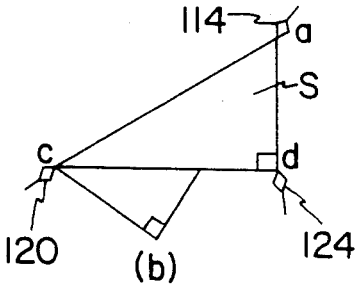
Figure 14:
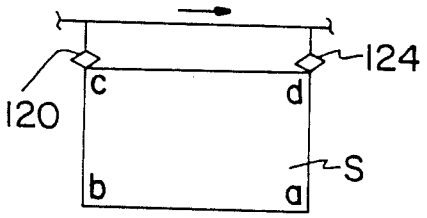
Figure 15:
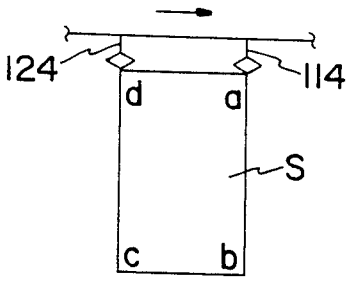

As the chuck 114 rises vertically, the corner d of the strip S of cloth approaches the position where it is suspended directly below the chuck 114 as shown in FIG. 13. The corner d is detected by the sensor 122 and then gripped by the chuck 124 of the fourth chuck conveyor E. Then, the chuck 114 is pulled by the operation of the drive means 129 in a state wherein the strip S of cloth is gripped at the corner a by the chuck 114 of the second chuck conveyor C, at the corner c by the chuck 120 of the third chuck conveyor D and at the corner d by the chuck 124 of the fourth chuck conveyor E and, at the same time, the chucks 120 and 124 are also pulled through the strip S of cloth. In this state, if the strip S is released from the hold by the chuck 114 and only the chucks 120 and 124 are transferred to the fifth chuck conveyor F and conveyed therethrough, then the strip S of cloth can be transported to the subsequent process (the ironing process) in a state wherein the strip S is spread in the direction of its long sides as shown in FIG. 14. If, in the state shown in FIG. 13, the strips S of cloth is released from the hold by the chuck 120 and only the chucks 114 and 124 are transferred to the sixth chuck conveyor G and conveyed therethrough, then the strip S can be transported to the subsequent process (the ironing process) in a state wherein the strip S is spread in the direction of its short sides as shown in FIG. 15.

The cloth strip gripping apparatus according to the present invention will next be described in detail.

Figure 16:
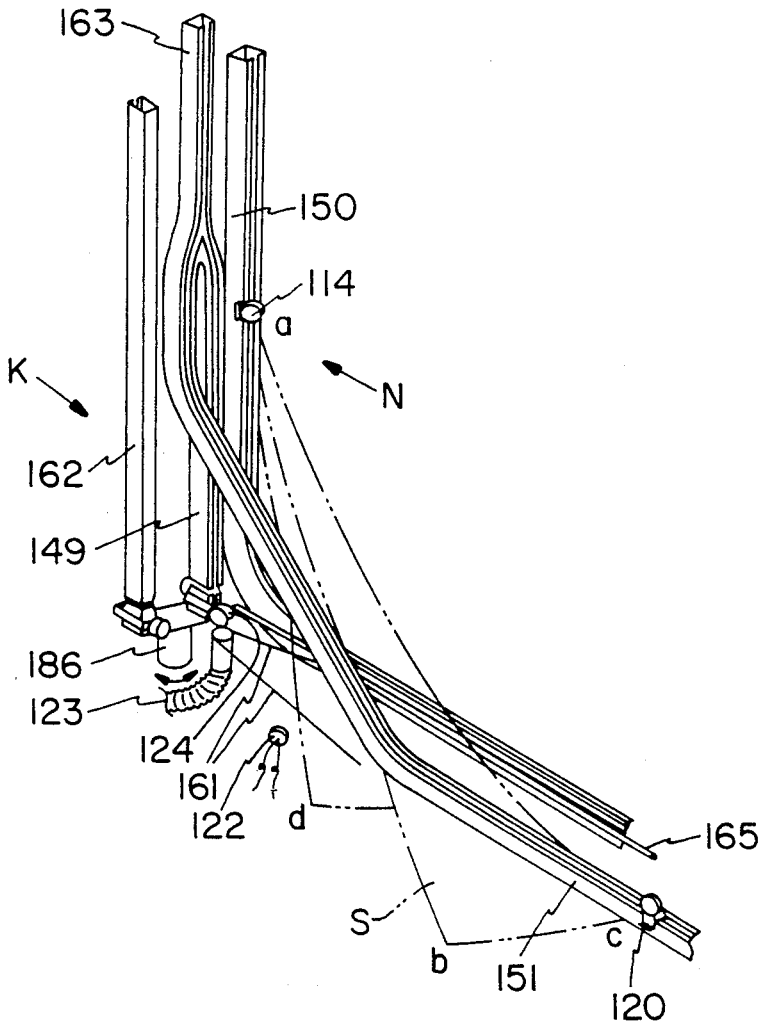
Figure 17B:
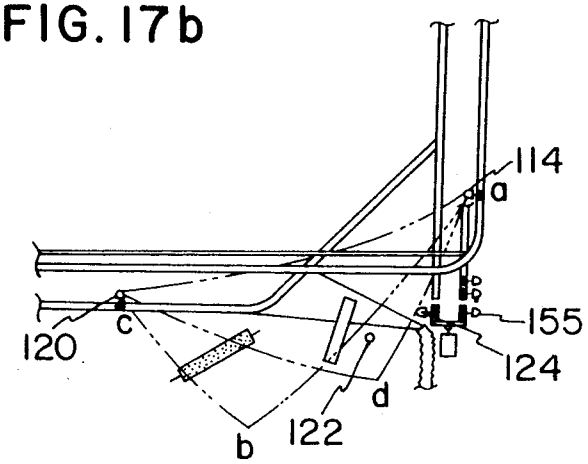
Figure 17D:
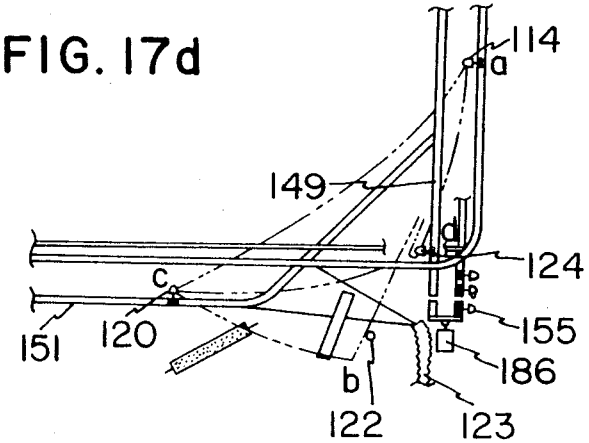
Figure 17A:
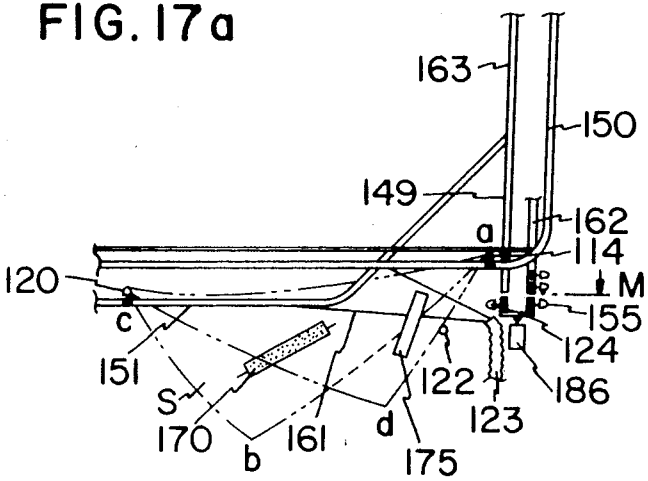
Figure 17C:
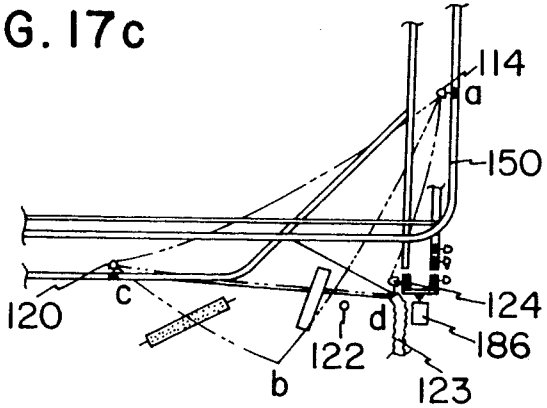
Figure 18A:
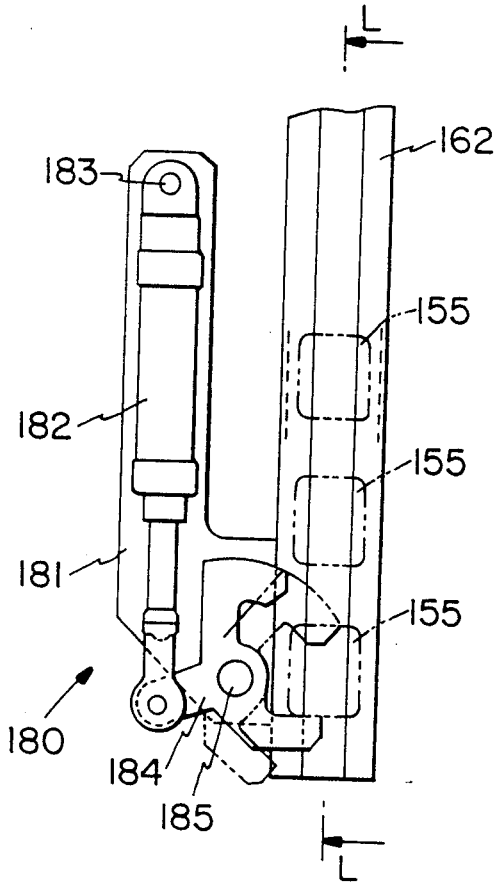
Figure 18B:
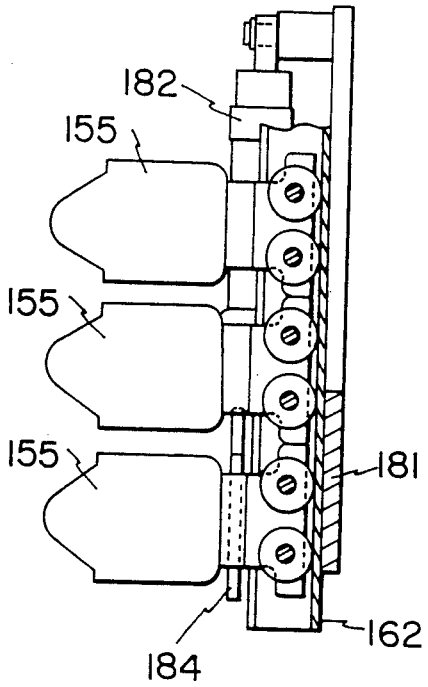
Figure 22:
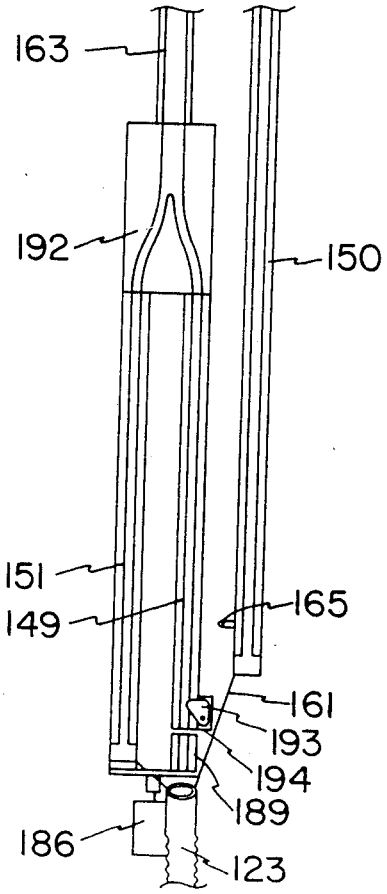

Referring to FIGS. 16 to 18, the reference numeral 151 denotes a rail along which moves the chuck 120 gripping the corner c of the strip S of cloth. It should be noted that in this case no driving force is usually applied to the chuck 120. The numeral 149 denotes a rail along which moves the chuck 124 gripping the corner d of the strip S of cloth. In this case also, no driving force is usually applied to the chuck 124. The numeral 150 denotes a rail to which the drive means 129 is attached and which guides the chuck 114 so as to rise substantially vertically. Guide bars 161 are disposed so as to sandwich the strip S of cloth in order to prevent flapping of the strip S. The numeral 162 denotes a rail along which successively return empty chucks 155 which have transported the strips S of cloth to the subsequent process (the ironing process) and released them from their hold. A rail 163 is arranged so that the chuck 120 in the rail 151 and the chuck 124 in the rail 148 join together, and a junction plate 192 is interposed at the junction of the two rails as shown in FIG. 22. A bar 165 is provided between the strip S of cloth and the rail for the purpose of preventing the cloth S coming into contacting with the rail 150 due to the fact that the chucks 114 and 120 face upward.

Figure 20:
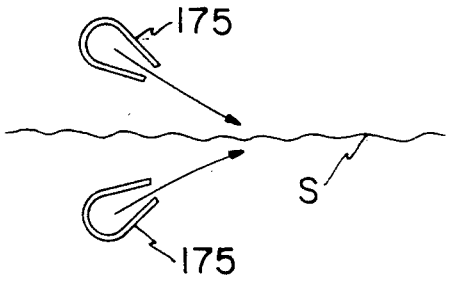
Figure 21:
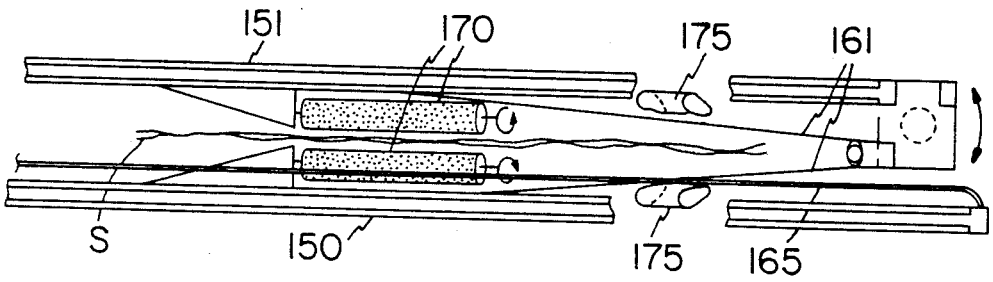

Brushes 10 are rotatably supported on drive shafts (not shown) below the rails 150 and 151, respectively, to unwrinkle both sides of the strip S of cloth so that the corner d is readily gripped (see FIG. 21). Air nozzles 175 are provided between the rails 150 and 151, respectively, to jet out compressed air for the purpose of achieving the effects described above (see FIGS. 20 and 21). The numeral 180 denotes a chuck feeder which is arranged such that, as shown in FIG. 18, an air cylinder 182 is provided so as to be pivotal about a pin 183 which is attached to a plate 181 rigidly secured to a rail 162, and a cam 184 is attached to the distal end of the rod of the air cylinder 182 so that the cam 184 is pivotal about a pin 185. The operation of the air cylinder 182 causes the cam 184 to pivot so as to feed chucks 155 downward one by one.

Figure 19:
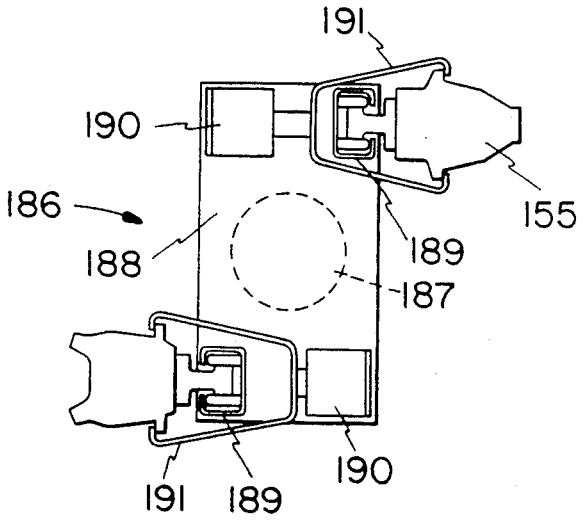
Figure 23:
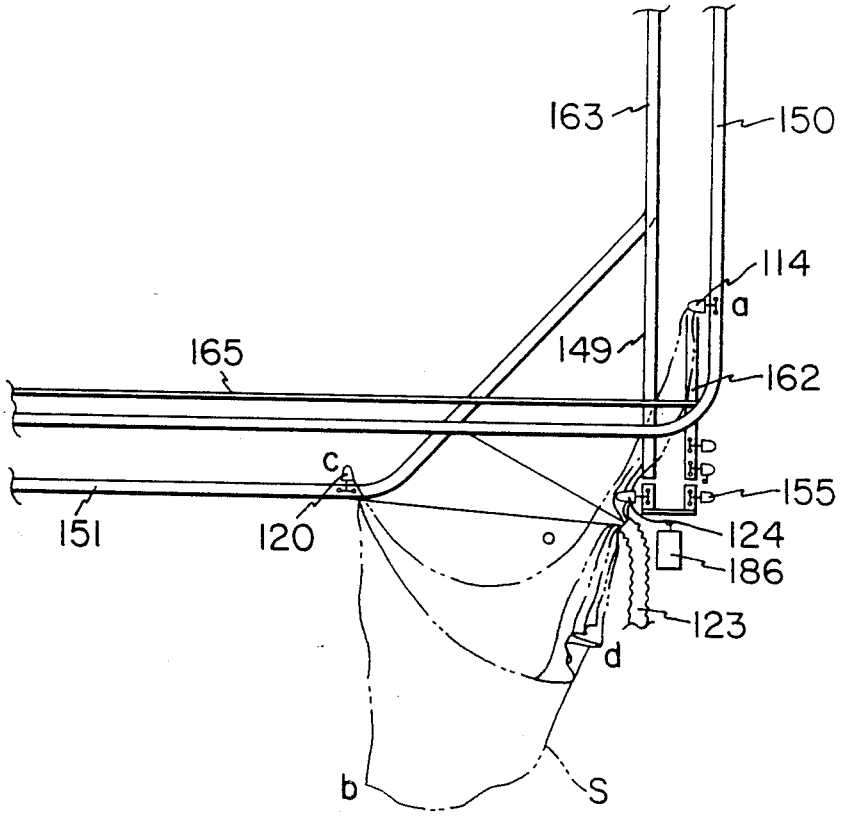

The reference numeral 186 denotes a chuck feed and turn means which is installed below the rails 149 and 162 as shown in FIG. 23. Further, accepting rails 189 are rigidly secured to the surface of a plate 188 attached to the rotating shaft of an indexing means 187 which, in turn, is secured to a fixed frame (not shown). The accepting rails 189 are provided in opposing relation to the rails 149 and 162, respectively, and disposed at such positions that chucks fed from the rails 149 and 162 can smoothly enter the corresponding rails 189. On the plate 188 are secured air cylinders 190 for opening the chucks 155 and arms 191 for transmitting the power from the air cylinders 190 to the chucks 155 (see FIG. 19). A return stopper 193 is prepared in case of ungripping of the strip S of cloth when the chuck 124 in the rail 49 rises through the rail 149 while gripping the corner d of the strip S and while being pulled by the chuck 114 through the strip S. Further, the chuck 124 moves upward against the pressing force applied to the stopper 193 from a spring (not shown), the stopper 193 being provided so as to be pivotal about a pin 194 as shown in FIG. 22.

Figure 24A:
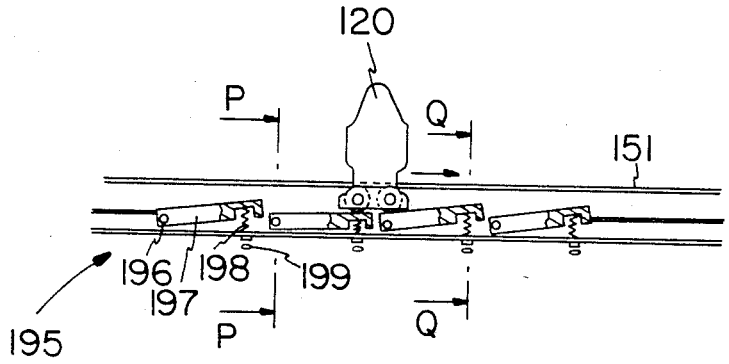
Figure 24B:
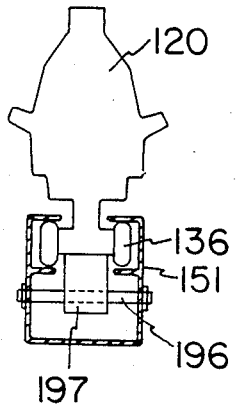
Figure 24C:
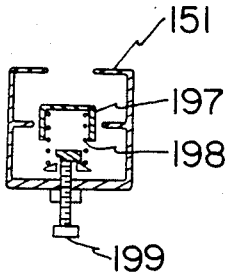

FIG. 24 shows one example of a chuck braking means (spring loaded type). In the figure, the reference numeral 195 denotes a chuck braking means in which a chuck 120 smoothly moves through a rail 151 since the chuck 120 has the rollers 136 as illustrated in FIG. 4. It is important in order to reliably grip the corner d of the strip S of cloth to apply braking force to the chuck 120 so that the portion of the strip S between the corners a and c is prevented from sagging. The chuck braking means is provided for this purpose. Pins 196 are rigidly secured inside the rail 151, and braking members 197 are provided so as to be pivotal about the corresponding pins 196. The braking members 197 are biased by means of springs 198 so that the braking members 197 are pressed against the back of the chuck 120. The braking force can readily be adjusted by varying the depth to which a bolt 199 is screwed.

The method of gripping the corner d of the strip S cf cloth will next be explained with reference to FIG. 17.

Referring first to FIG. 17(*a*), the chuck 114 which is gripping the corner a of the strip S of cloth is moved through the rail 150 by the operation of the drive means 129. The corner c of the strip S is gripped by the chuck 120. Since the chucks 114 and 120 grip the strip S in the state that the gripping points are situated above, the bar 165 is provided for the purpose of preventing the strip S from being stained and damaged. In this way, the strip S is conveyed as illustrated.

Since the chuck braking means 195 is provided for the chuck 120, an appropriate tension is applied to the portion of the strip S between the corners a and c, and this makes it possible to increase the probability of the corner d of the strip S being successfully gripped. If no tension is applied to the strip S, it sags as shown in FIG. 23 and it is difficult to grip the corner d of the strip S. In addition, the strip S is unwrinkled or disentangled by the action of any one the pairs of brushes 170, air nozzles 175 and guide bars 161 or a combination thereof. In the case where the rate of transport of the strip S is relatively low, these unwrinkling mechanisms may be unnecessary.

Referring next to FIG. 17(*b*), when the strip S of cloth reaches the illustrated position, the sensor 122 turns ON. At this time, an empty chuck 155 has already been fed to the accepting rail 189 in the chuck feed and turn means 186 and turned by rotating the indexing means 187 so as to stand by at a predetermined position (such a position that it is movable to the rail 149) as a chuck 124 for gripping the corner d of the strip S.

Referring now to FIG. 17(*c*), as the chuck 114 rises through the rail 150, the strip S of cloth comes out of the detectable range of the sensor 122, and the sensor 122 outputs an OFF signal. At this time, the lower side of the strip S between the corners c and d has already become substantially horizontal, and the corner d of the strip S is thus sucked into the air suction means 123. When a time set on a timer (not shown) has elapsed after the OFF signal has been output from the sensor 122, the air cylinder 190 is activated to disengage the arm 191 from the chuck 124, thereby allowing the chuck 124 to close while gripping the corner d of the strip S.

Referring now to FIG. 17(*d*), as the chuck 114 further rises through the rail 154, the chucks 120 and 124, which are pulled through the strip S, move through the rails 151 and 149 while gripping the corners c and d of the strip P. Thereafter, a subsequent chuck 155 is turned to the position of the chuck 124 by the operation of the chuck feed and turn means 186, and an empty chuck 155 following this chuck 155 is fed into the chuck feed and turn means 186 by the operation of the chuck feeder 180.

Figure 25A:
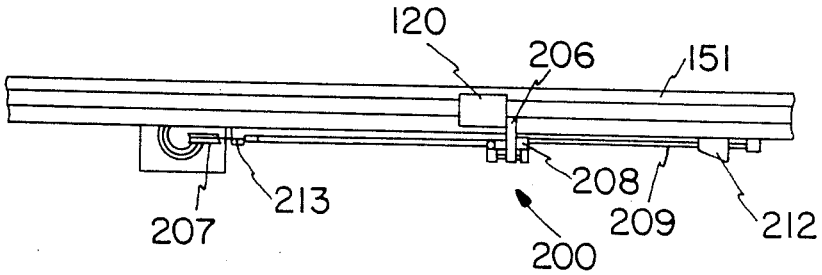
Figure 25B:
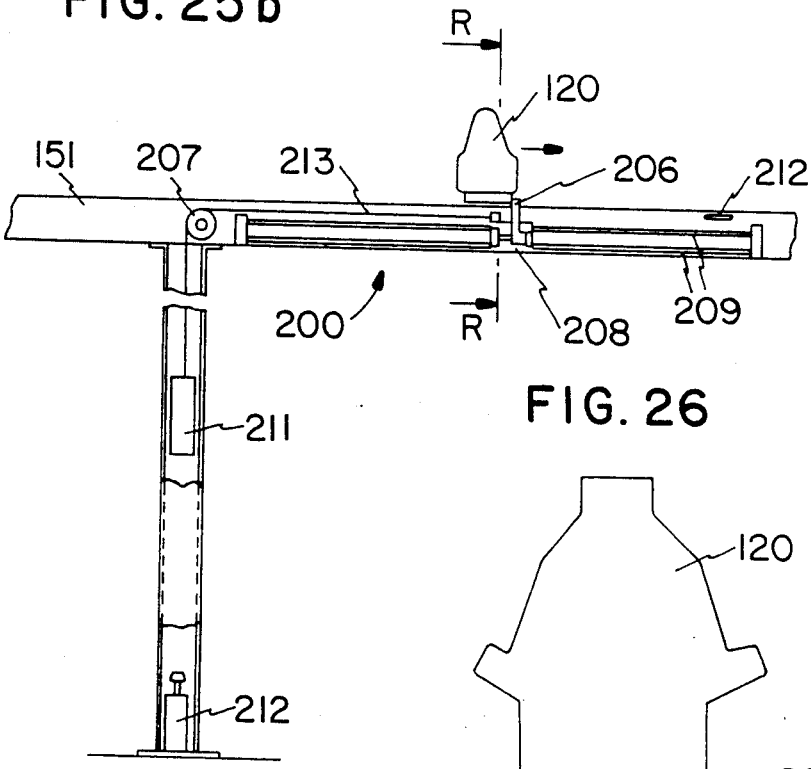
Figure 26:
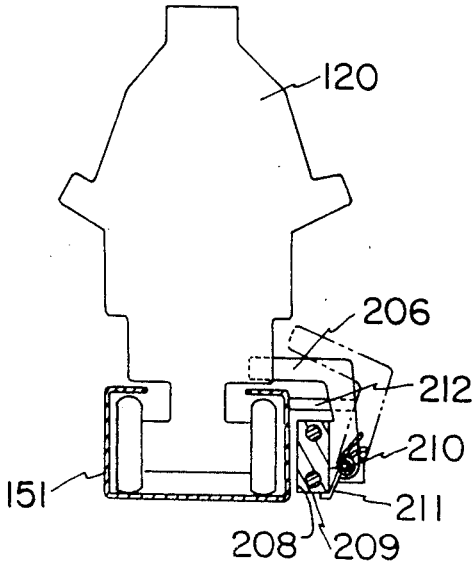

Referring next to FIG. 25, which shows one example of a chuck braking means (balance weight type), a chuck braking means 200 is arranged to brake the movement of the chuck 120 by means of a balance weight 211 A slider 208 is provided on one side of the rail 151 so as to be slidable along bars 209. The slider 208 is provided with a hook 206 in such a manner that the hook 206 is pivotal about a pin 210 and biased by means of the balance weight 211 as shown in FIG. 26. The hook 206, when reaching an opener 212 rigidly secured to the rail 151, is opened as shown by the two-dot chain line in FIG. 26. The balance weight 211 is suspended at the distal end of a wire 213 which is connected to the slider 208, the balance weight 211 being allowed to move vertically through a roller 207. The braking force can readily be changed by varying the weight of the balance weight 211.

One means, which can be used in the part denoted by the symbol A in FIG. 1 showing the above-described first embodiment and which is arranged to suck a strip S of cloth on the belt conveyors 101 and 102 and grip it with a chuck, will next be explained with reference to FIGS. 33 to 40.

Figure 33:
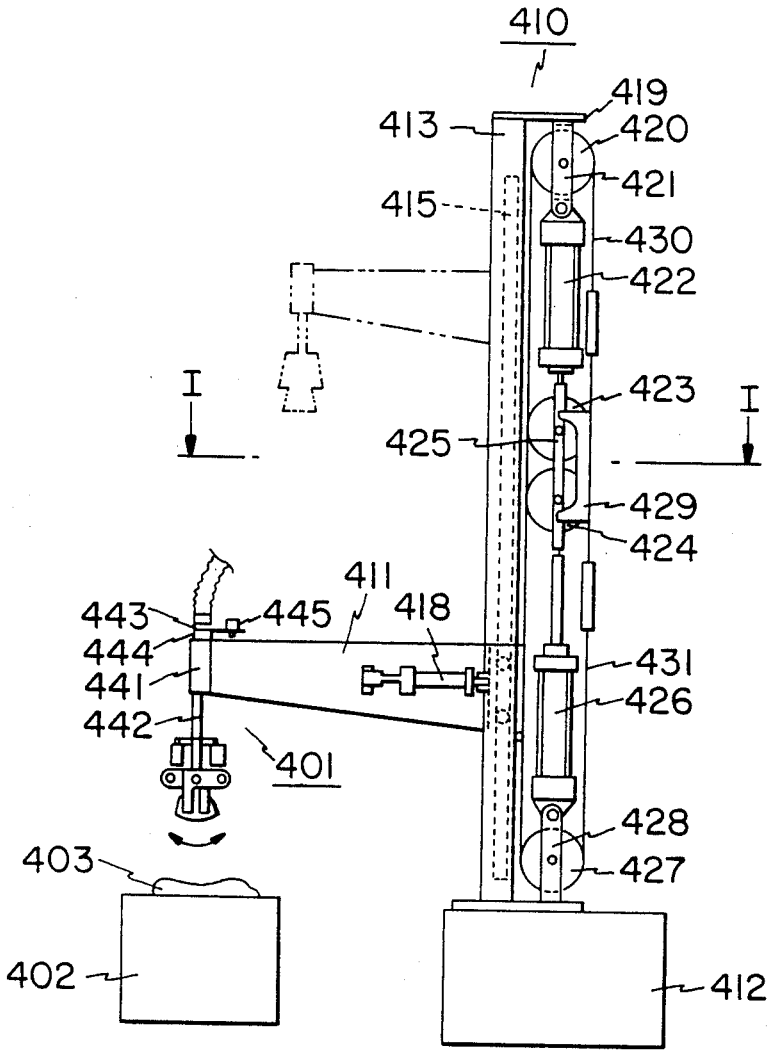
Figure 34:
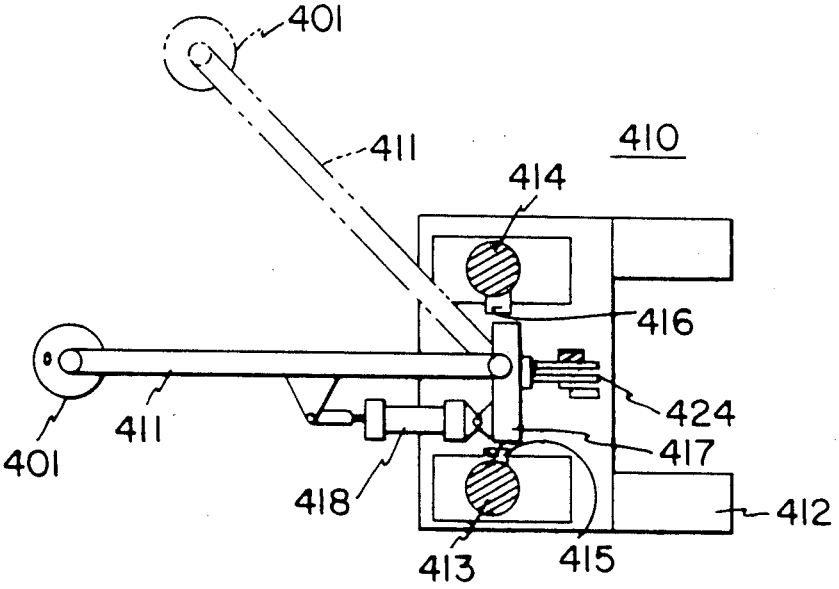

FIG. 33 shows the arrangement of a cloth strip pick-up means to which a cloth strip gripping apparatus 401 is applied, and FIG. 34 is a sectional view taken along the line I—I in FIG. 33. The cloth strip gripping apparatus 401 is arranged such as to suck up a portion of a strip from a mass of cloth transported by a transport conveyor 402 and to grip the picked up strip As shown in FIG. 33, the cloth strip gripping apparatus 401 is attached to the distal end of an arm portion 411 which, in turn, is attached to the body 410 of the cloth strip pick-up means 410 so that the arm portion 411 is movable both vertically and horizontally. The arrangement of the body 410 of the cloth strip pick-up means will first be explained. The body 410 of the pick-up means has two supports 413 and 414 which are rigidly secured to the surface of a base 412. Rails 415 and 416 are respectively provided on the opposing inner sides of the supports 413 and 414. A support plate 417 is provided between the rails 415 and 416 through rollers or other similar means in such a manner that the support plate 417 is vertically movable along the rails 415 and 416 serving as guide rails. The above-described arm portion 411 is attached to the support plate 417. The arm portion 411 is pivotal horizontally by the operation of a first air cylinder 418 provided between the same and the support plate 417.

Figure 35:
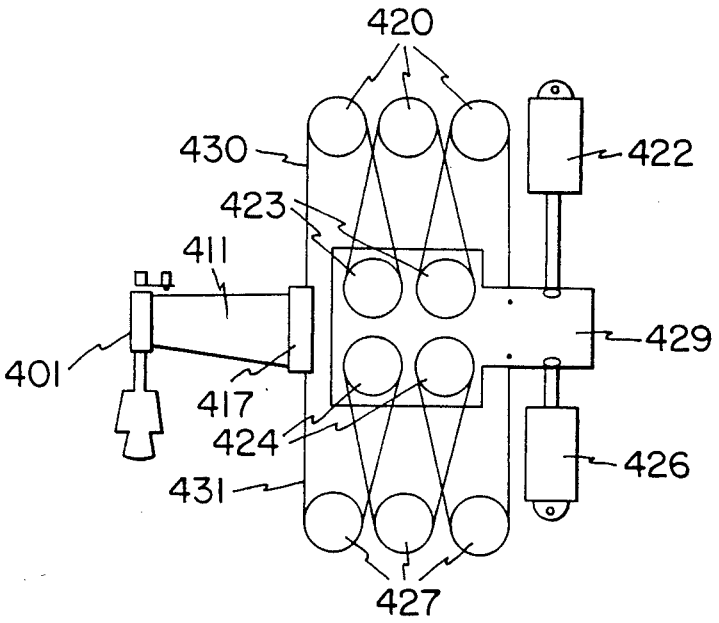

On the other hand, a plate 419 is rigidly secured between the respective top portions of the supports 413 and 414. A bracket 412 which rotatably supports a pulley 420 is rigidly secured to the plate 419 by means, for example, of a bolt. One end of a second air cylinder 422 is connected to the other end of the bracket 421, and the other end (the rod-side end) of the second air cylinder 422 is connected to a bracket 425 which rotatably supports pulleys 423 and 424. A third air cylinder 426 is connected at one end (the rod side end) thereof to the bracket 425 and at the other end to the distal end of a bracket 428 which is rigidly secured to the base 412 and which rotatably supports a pulley 427. Ropes 430 and 431 are stretched between and wrapped around the pair of pulleys 420 and 423 and the pair of pulleys 424 and 427, respectively, each of the ropes 430 and 431 being connected at one end thereof to a plate 429 rigidly secured to the bracket 425 and at the other end connected to the above-described support plate 417, as shown in FIG. 35.

Figure 36:
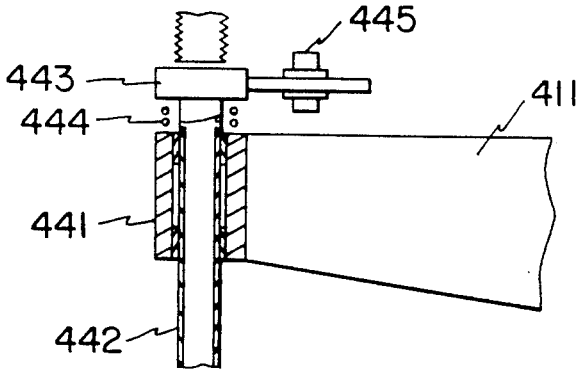

The arrangement of the cloth strip gripping apparatus 401 will next be described. The joint between the apparatus 401 and the arm portion 411 will first be explained. As shown in FIG. 36, a guide mechanism 441 is rigidly secured to the distal end of the arm portion 411 in such a manner as to be integral with the arm portion 411, the guide mechanism 441 being arranged to guide an air suction nozzle 442 so that the nozzle 442 is slidable vertically. The air suction nozzle 442 is connected to a suction source (not shown) such as a blower and adapted to suck up a mass of cloth 403 by suction of air, the nozzle 442 being stably retained by a holder 443. A resilient member 444 which is defined by a compression spring or the like is interposed between the holder 443 and the guide mechanism 441. When the arm portion 411 is raised while gripping a strips S of cloth by means of chucks 454 and 455 (described later), the resilient member 444 is compressed in accordance with the level of the lifting force applied to the chucks 454 and 455. Further, a proximity sensor 445 is attached to the holder 443 to detect the amount by which the resilient member 444 is compressed, that is, the gap between the sensor 445 and the arm portion 411.

Figure 37:
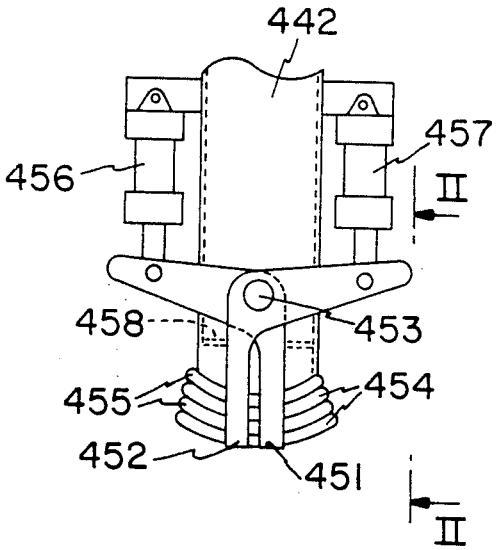
Figure 38:
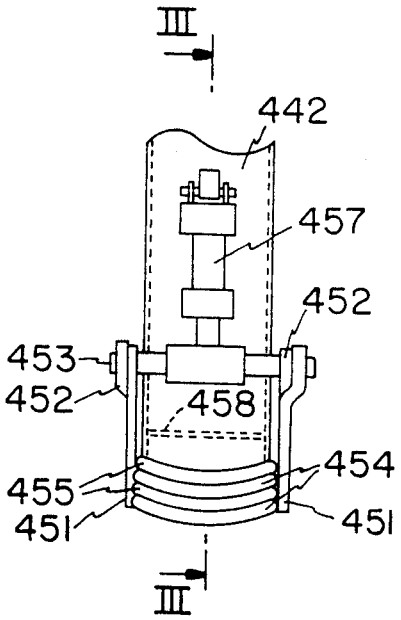
Figure 39:
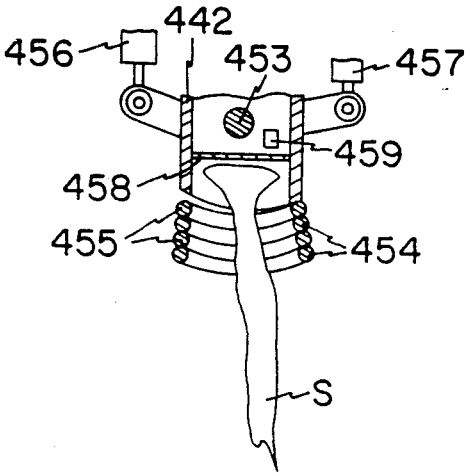
Figure 40:
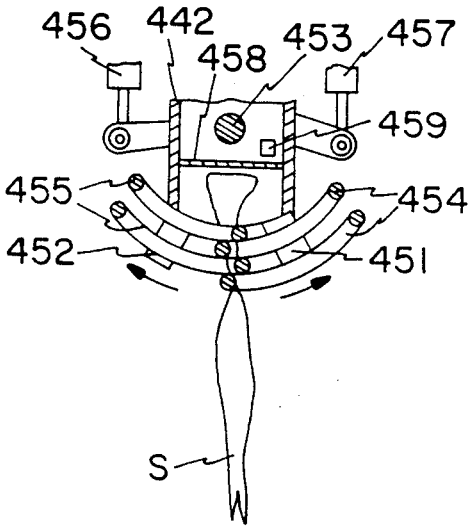
Figure 41:
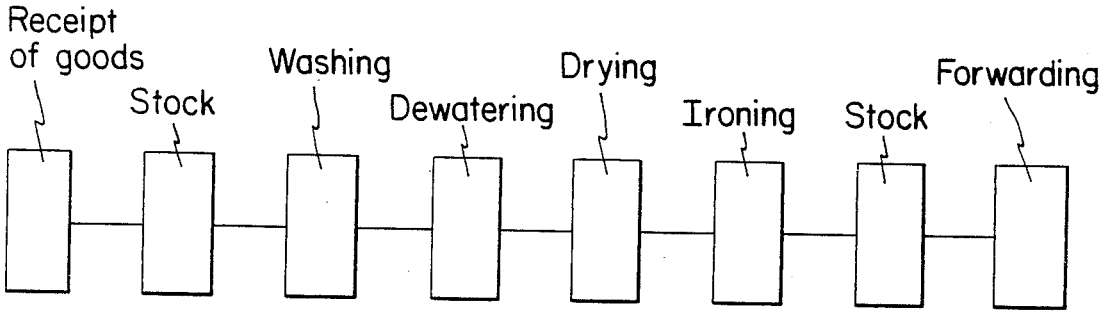
FIG. 41 PRIOR ART
FIG. 41 is a block diagram showing a washing process in conventional laundry works.
Figure 42:
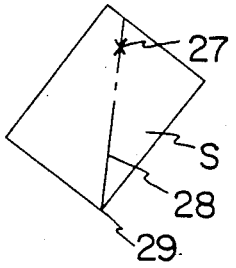
FIG. 42 PRIOR ART
FIGS. 42–50 illustrate a prior art method as disclosed in Japanese Patent Publication No. 59-24685.
Figure 43:
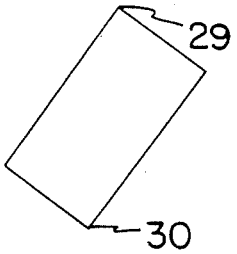
FIG. 43 PRIOR ART
Figure 44:
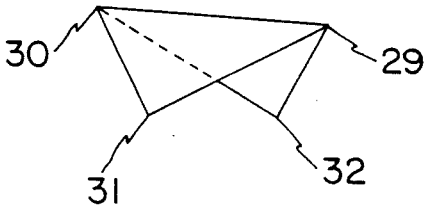
FIG. 44 PRIOR ART
Figure 45:
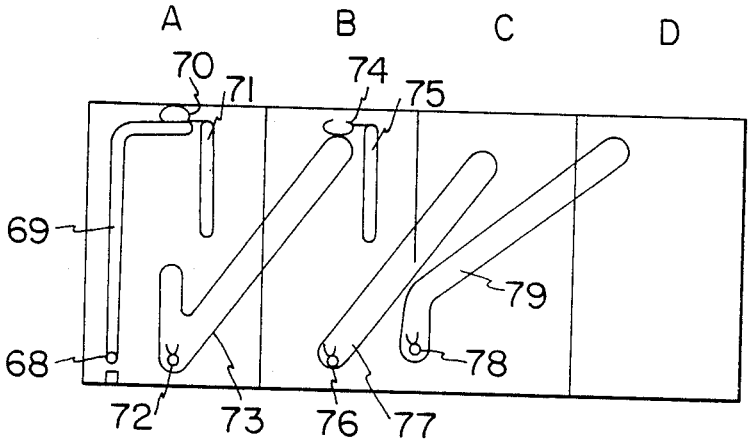
FIG. 45 PRIOR ART
Figure 46:
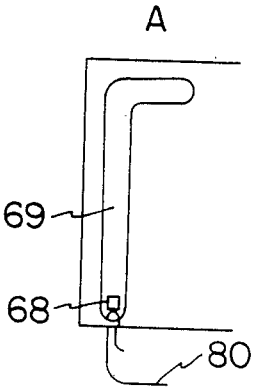
FIG. 46 PRIOR ART
Figure 47:
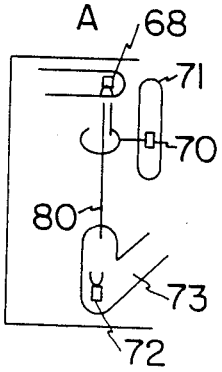
FIG. 47 PRIOR ART
Figure 48:
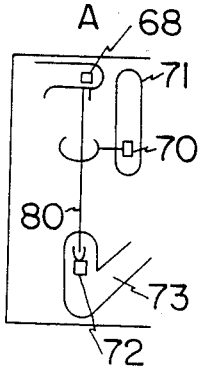
FIG. 48 PRIOR ART
Figure 49:
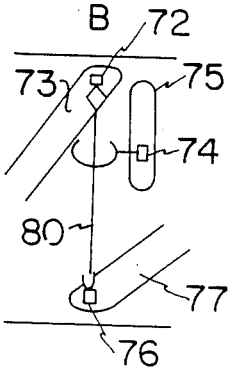
FIG. 49 PRIOR ART
Figure 50:
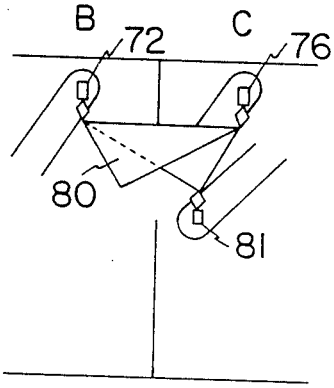
FIG. 50 PRIOR ART

The arrangement of the gripping mechanism will next be explained. FIG. 37 is a front view of the gripping mechanism, and FIG. 38 shows the gripping mechanism as viewed in the direction of the arrows II in FIG. 37. Further, FIGS. 39 and 40 are sectional views taken along the line III—III in FIG. 38. FIG. 39 shows the way in which a single strip S of cloth is suction held by the gripping mechanism, and FIG. 40 shows the way in which a single strip S of cloth is gripped by the gripping mechanism. In FIGS. 37 to 40, chuck arms 451 and 452 are pivotally supported by a shaft 453 which extends through the air suction nozzle 442, slide type chucks 454 being rigidly secured to one end of the chuck arm 451, and slide type chucks 455 to one end of the chuck arm 452. These chucks 454 and 455 have a projected planar configuration in accordance with the cross-sectional configuration (circular in this case) of the air suction nozzle 442 and assembled so that, when the chuck arms 451 and 452 are pivoted away from each other, the chucks 454 and 455 slide while minimizing the gap between the circular lower end of tho air suction nozzle 442 and the circular upper chuck 455 and the gap between each of adjacent circular chucks 455 and 454. The reference numerals 456 and 457 denote air cylinders which act as drive sources for the chucks 454 and 455. One end of each of the air cylinders 456 and 457 is connected to the air suction nozzle 442, and the other ends thereof are connected to the chuck arms 451 and 452, respectively. A porous plate 458 is provided inside the air suction nozzle 442 for the purpose of preventing a strip S from being excessively sucked up. A distance sensor 459 is disposed at the inner side of the porous plate 458. The distance sensor 459 is adapted to detect the position of the mass of cloth and to thereby control the timing at which the gripping apparatus 401 is moved vertically and the timing at which a strip S of cloth is gripped by the chucks 454 and 455.

It is assumed that the cloth strip gripping apparatus 401 is suspended in a position shown by the broken line in FIG. 33. When, in this state, a mass of cloth 403 is transported by the transport conveyor 402 in a state wherein the mass of cloth 403 is disentangled to a certain extent, the second and third air cylinders 422 and 426 are activated to lower the arm portion 411, and when it is judged on the basis of the detection signal output from the distance sensor 459 that the cloth strip gripping apparatus 401 has lowered to an optimal position (the position shown by the solid line in FIG. 33) with respect to the mass of cloth 403, the operation of the second and third air cylinders 422 and 426 is suspended. Then, the air suction nozzle 442 is activated to suck up the mass of cloth 403, and immediately after the start of the operation of the air suction nozzle 442, the chuck driving air cylinders 456 and 457 are activated to slide the chucks 454 and 455. In this way, when the suction operation is conducted, a portion of a strip S of cloth is sucked up inside the chucks 454 and 455 as shown in FIG. 39, and when the chucks 454 and 455 are activated to slide, the portion of the strip S sucked up is gripped by the chucks 454 and 455 as shown in FIG. 40. Thereafter, the second and third air cylinders 422 and 426 are operated in reverse to the above to raise the arm portion 411, and the cloth strip gripping apparatus 401 is also raised together with it. At this time, if the strip S of cloth gripped by the chucks 454 and 455 is entangled with other strips of cloth to load an excessively large strip lifting force on the chucks 454 and 455, the resilient member 444 is compressed and the gap between the proximity sensor 445 and the arm portion 411 is reduced. Thus, an abnormal state of the strip S is detected in accordance with a detection signal output from the proximity sensor 445, and the chuck driving air cylinders 456 and 457 are activated to return the chucks 454 and 455 to the state shown in FIG. 39, thus releasing the strip S from the gripped state.

On the other hand, when the strip S is raised smoothly, the first cylinder 418 is activated in a state wherein the strip S is gripped. In consequence, the arm portion 411 is pivoted horizontal as shown in FIG. 34. In addition, the second and third air cylinders 422 and 426 are activated to allow the arm portion 411 to move vertically, thus enabling the strip S to be transported to a predetermined position Thus, according to this apparatus, the surface of the mass of cloth 403 is sucked to suck up a portion of a strip S of cloth, and the portion of the strip S thus sucked is then gripped by the chucks 454 and 455. Accordingly, it is possible to automatically and reliably pick up and grip a single strip S of cloth alone from the mass of cloth 403 without the need for any manual operation. Since, during the suction operation, the chucks 454 and 455 are opened to define a part of the suction port, there is no fear of the suction pressure being lowered. In addition, the porous plate 458 is provided in the intermediate portion of the air suction nozzle 442 to prevent the strip S from being excessively sucked up. Therefore, there is less fear of two strips S of cloth being picked up at a time and also a less risk of a strip S of cloth being entangled with the tip of the nozzle. Further, if a gripped strip S of cloth is entangled with other strips of cloth to load an excessively large lifting force on the chucks 454 and 455, the strip S is released from the gripped state. Therefore, there is no risk of the strip S of cloth being damaged. In this apparatus, the distance sensor 459 is provided inside the air suction nozzle 442 to detect the distance between the same and a mass of cloth 403 which is to be gripped, thereby controlling the closing operation of the chucks 454 and 455 and also the vertical movement of the arm portion 411. Accordingly, it is possible to effect a cloth strip gripping operation at a preferable position for picking up a strip S regardless of the position and configuration of the mass of cloth 403. In addition, since the distance sensor 459 is positioned at the inner side of the porous plate 459, there is no fear of the sensor 459 being damaged.

Figure 27A:
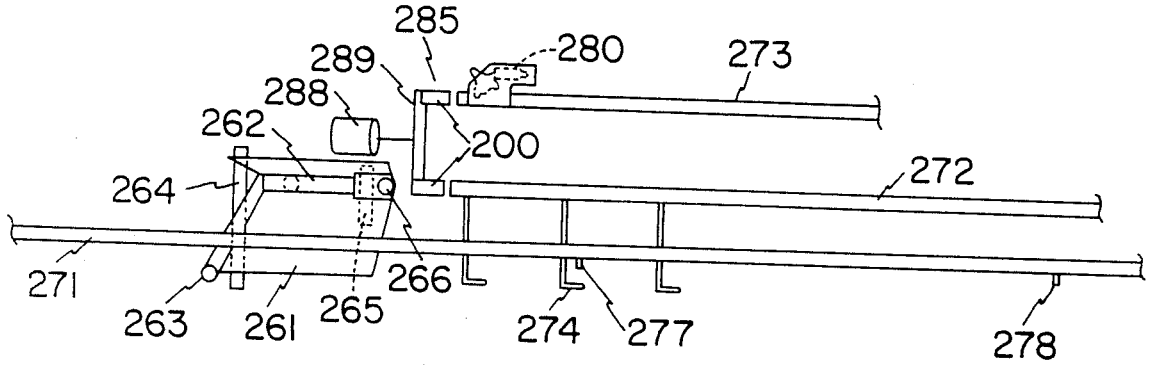
Figure 27B:
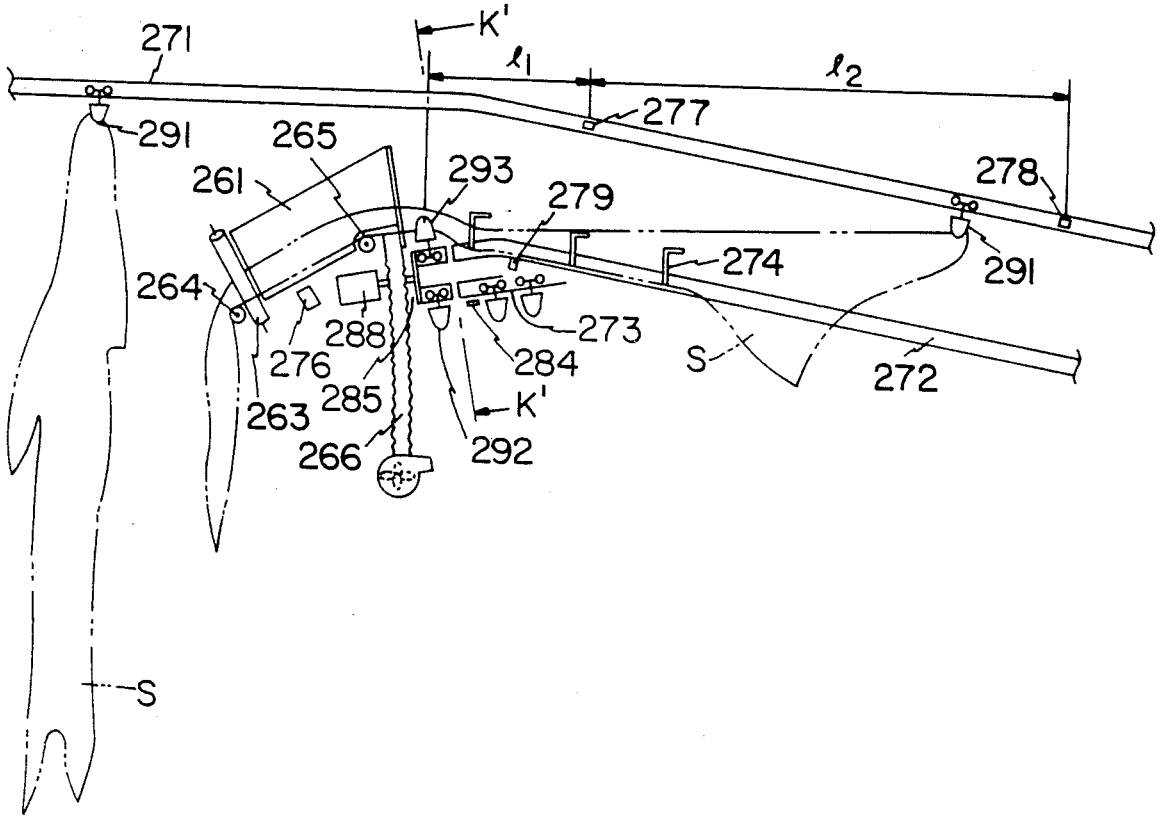
Figure 27C:
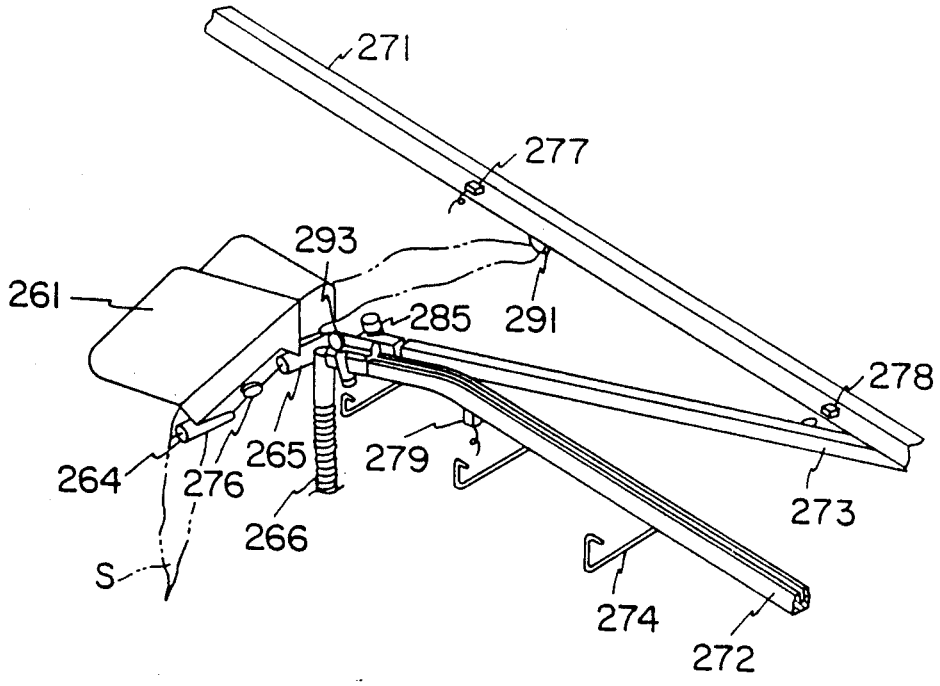
Figure 28A:
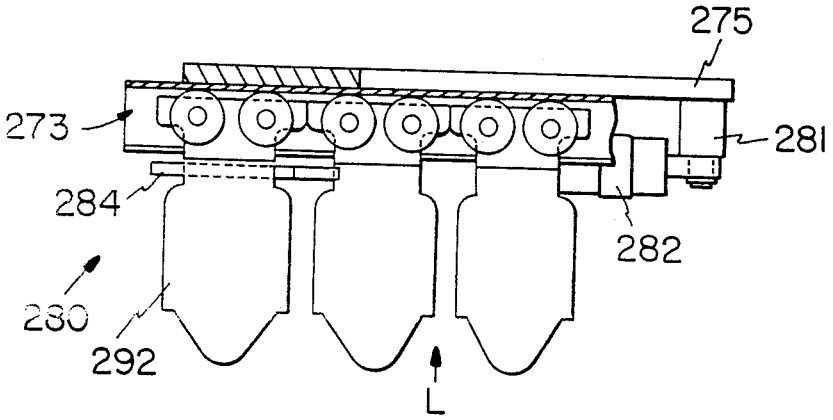
Figure 28B:
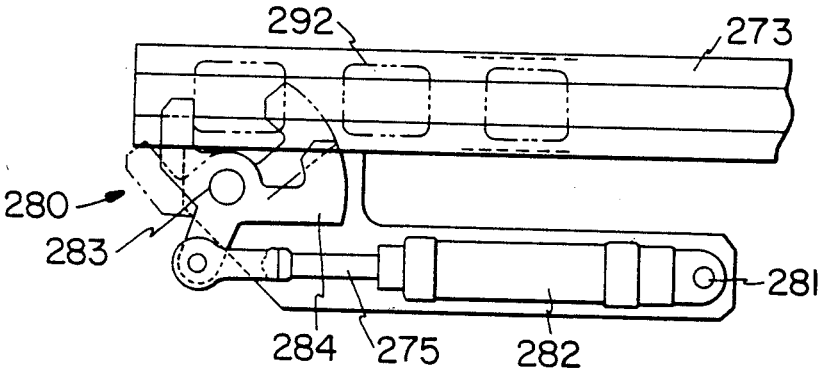
Figure 29:
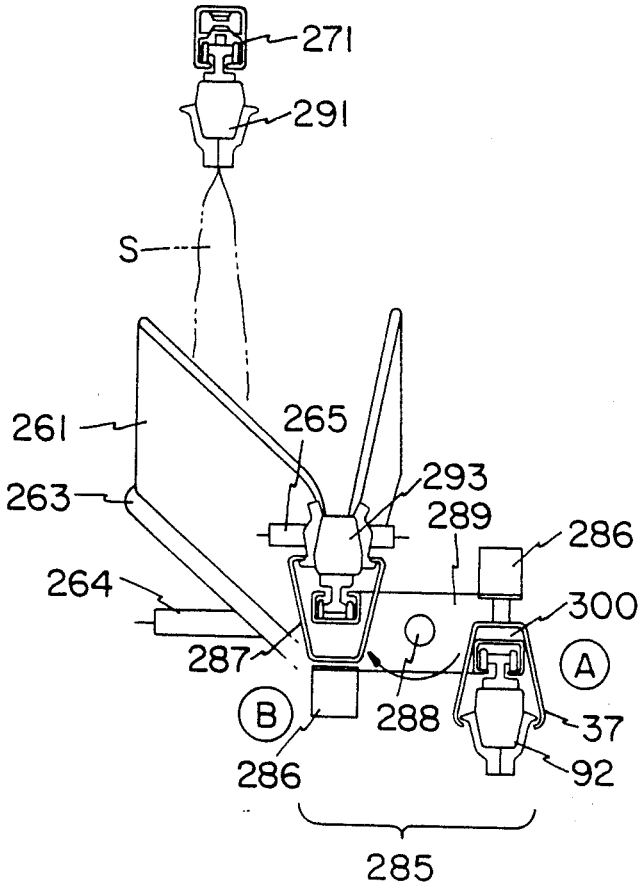

A second embodiment of the present invention will next be described with reference to FIGS. 27 to 29. Since this embodiment has an arrangement similar to that of the first embodiment except for a strip end gripping apparatus described below and some other portions, description of the mutual portions is omitted. In the figures, the reference numeral 261 denotes a squeezing means which is similar to those denoted by the numerals 111 and 117 in FIGS. 1 and 2 and which replaces the squeezing means 111 and 117 in the first embodiment. The squeezing means 261 is adapted to squeeze a strip S which is transported while being gripped by a chuck 291 shown in FIG. 27(*b*). The squeezing means 261 is usually formed from a stainless steel sheet and provided with rotatable guide rolls 263, 264 and 265 in the vicinities of the input and outlet portions of the squeezing means 261 in order to lower the coefficient of friction between the strip S of cloth and the squeezing means 261. The numeral 262 denotes a squeezing groove provided in the squeezing means 261. The strip S of cloth is squeezed along the groove 262 in order to enable the end of the strip S to be readily gripped. A sensor 276 is disposed in a portion of the squeezing groove 262 to output a signal indicating the passage of the strip S.

An air suction means 266 is provided in order to suppress flapping of the strip S by means of suction, thus enabling the strip S to be gripped reliably and effectively. The numeral 271 denotes a guide rail along which a chuck 291 travels, the chuck 291 being usually driven through a chain 138 or the like such as that shown in FIG. 4 so as to move through the guide rail 271. Another guide rail 272 is a transport rail that is used when a chuck 293 gripping a corner portion of the strip S is driven by the chuck 291 through the strip S. Still another guide rail 273 is arranged such that empty chucks 292 travel by gravity through the rail 273 slanted downward, the chucks 292 being fed, one by one, into a chuck feed and turn means 285 (described later) by the operation of a chuck feeder 280.

The reference numeral 274 denotes a predetermined number of guide bars which are provided on the starting portion of the guide rail 272 to prevent the chuck 293 from miscatching the strip S. More specifically, the corner portion of the strip S gripped by the chuck 291 is squeezed by the squeezing means 261 and advanced to pass the air suction means 266. At this time, the corner portion of the strip S may spring up as a reaction due to its own weight, and the chuck 293 may fail to catch the strip S. For this reason, the guide bars 274 are provided to enable the chuck 293 to catch the strip S reliably and effectively. The guide bars 274 are not necessarily limitative, and plates, rolls and the like may also be practically used. A plate 275 is rigidly secured to the guide rail 273 for the purpose of attaching an air cylinder 282 in the chuck feeder 280 (see FIG. 28).

The reference numerals 277 and 278 denote photoelectric sensors, proximity sensors or the like which are rigidly secured to the guide rail 271 to check the passage of the chuck 291 gripping the strip S of cloth. The dimension $l_1$ shown in FIG. 27(*b*) is determined so that, when chuck 291 reaches the position of the sensor 277, the operation of the sensor 276 is started The dimension $l_2$ for the sensor 278 is determined so that, when the chuck 291 gripping the strip S reaches the position of the sensor 278, the trailing corner portion of the strip S has adequately passed the position of the chuck 293.

A sensor 279 is rigidly secured to the guide rail 272 to check the fact that the chuck 293 gripping the trailing corner portion of the strip S has come out of the chuck feed and turn means 285 by being pulled through the strip S. The chuck feeder 280 is arranged to temporarily stock empty chucks 292 returned to the guide rail 273 as shown in FIG. 28 and to reliably feed them into the guide rail 272 one by one. A pin 281 is rigidly secured to the plate 275 to allow the air cylinder 282 to pivot about the pin 281. Another pin 283 is rigidly secured to the plate 275 for allowing a cam 284 to pivot about it. The cam 284 is connected to the rod of the air cylinder 282 and selectively brought to two positions shown by the solid line and the two-dot chain line, respectively, in FIG. 28(*b*) in response to the operation of the air cylinder 282. Thus, the cam 284 repeats the temporary stock and feed of a chuck 292 for each stroke of the air cylinder 282, thereby feeding chucks 292, one by one, into the chuck feed and turn means 285. The chuck feed and turn means 285 is arranged such that, as shown in FIG. 29, an empty chuck 292 which is fed from the chuck feeder 280 is accepted into an accepting rail 300 in the section Ⓐ, and an air cylinder 286 is activated so as to cause an arm 287 to apply force to the chuck 292 in the direction of the arrows in FIG. 4(*a*) in order to open the chuck 292. Thereafter, the chuck 292 is rotated 180° in the direction of the arrow in FIG. 29 by the operation of an indexing means 288 so that the chuck 292 is positioned in the section Ⓑ. The chuck 293 illustrated in the section Ⓑ is the same as the chuck 292. After the passage of the trailing corner of the strip S has been confirmed, the chuck 293 is closed to grip the corner portion of the strip S and then transported through the guide rail 272 by means of the driving force transmitted thereto from the chuck 291 through the strip S. The accepting rails 300 respectively face the guide rail 273 in the section Ⓐ and the guide rail 272 in the section Ⓑ so that the chucks 292 and 293 can be smoothly moved between the rails 273 and 272. It should be noted that the number (2) of divisions in the indexing means 288 is not necessarily limited thereto. A plate 289 is rigidly secured to the indexing means 288 which, in turn, is secured to a bracket (not shown). On the plate 289 are mounted the rails 300 for accepting chucks 292 and 293, the air cylinders 286 and the arms 287 for opening the chucks 292 and 293. The plate 289 may be associated with a damper (not shown) so as to absorb energy at the time when the rotated plate 289 is suspended.

The following is a description of the operation of the second embodiment. Referring to FIGS. 27 to 29, the chuck 291 gripping the strip S of cloth is transported through the guide rail 271 by means of the chain 238 as shown in FIG. 4. The squeezing means 261 is located below the guide rail 271, and the strip S is thus squeezed by the squeezing means 261. When the passage of the trailing corner portion of the strip S is detected by means of the sensor 276, the chuck 293 is closed in response to the detection signal output from the sensor 276. The temporal relationship between the detection signal output from the sensor 276 and the closing operation of the chuck 293 is usually adjusted by means of a timer (not shown) so that gripping of the trailing corner portion of the strip S is reliably effected.

The guide rolls 263, 264 and 265 are effective in lowering the coefficient of friction between the squeezing means 261 and the strip S. If the squeezing means 261 is installed at an appropriate angle, it may be possible to eliminate the need to provide guide rails. When the trailing corner portion of the strip S reaches a position immediately before the chuck 293, suction is effected by the air suction means 266, so that the corner portion of the strip S is instantaneously gripped and it is thereby possible to eliminate the possibility of the strip S flapping and to apply tension to the strip S, which is effective in allowing the chuck 293 to grip the corner portion of the strip S, particularly the corner of the corner portion. It should be noted that, although in the above described embodiment air suction is employed, it is also possible to achieve effects equivalent to the above by blowing air against the strip S from the upper side of the squeezing means 261 contrary to the above. However, this alternative procedure has the problems that the rate of consumption of air is disadvantageously high and the noise level is also unfavorably high. The guide bars 274 are adapted to support the weight of the strip S in order to prevent any unstable movement of the strip S by gravity at the position of the air suction means 266 disposed at the outlet of the squeezing means 261, and the guide bars 274 are therefore important members for enabling the chuck 293 to reliably grip the corner portion of the strip S.

Chucks 293 for gripping the corner of a strip S of cloth are fed to the guide rail 272, one by one, from the guide rail 273 by the operation of the chuck feeder 280 and the chuck feed and turn means 285. The dimension $l_1$ is determined so that, when the chuck 291 reaches the position of the sensor 277, the air suction means 266 is activated. The sensor 278 turns ON when the chuck 291 gripping the strip S reaches the position of the sensor 278. If, at this time, the chuck 293 is present at the previous position, the chuck 293 cannot pass the position of the sensor 279. Accordingly, this is regarded as a failure in gripping, and the chuck 291 is caused to drop the strip S which has been gripped thereby onto the belt conveyor 132 (see FIG. 3), or the strip S is transported onto the belt conveyor 132 by other known means. It should be noted that, although in the above-described embodiment the present invention is applied to the cloth spreading system, the present invention may similarly be applied to a system for sorting linens or other textile products.

Figure 30:
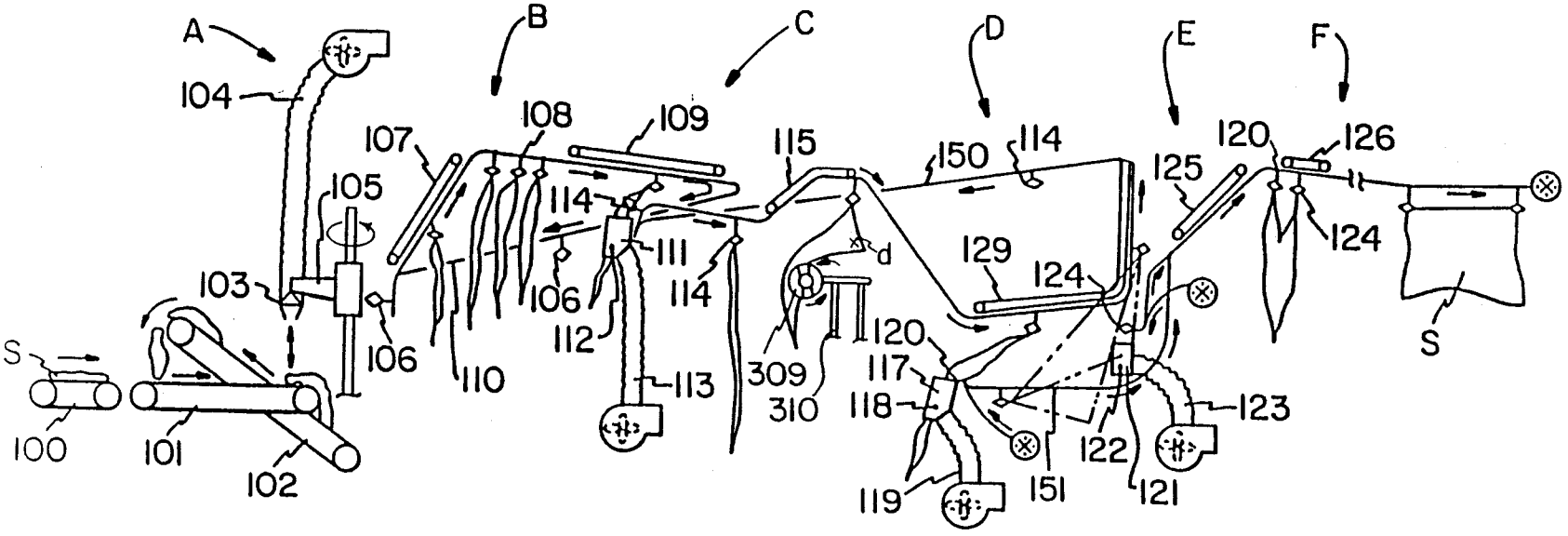
Figure 31:
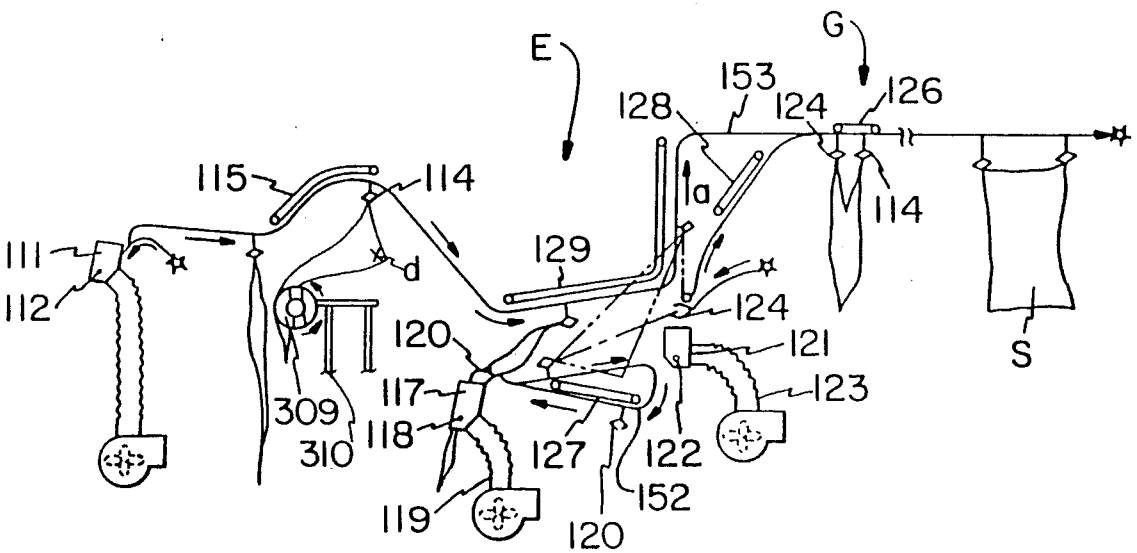

A third embodiment of the present invention will next be described with reference to FIGS. 30 to 32. This embodiment features that, as shown in FIGS. 30 and 31, the second chuck conveyor C in accordance with the above-described first and second embodiments is provided with a vibrating roller 308 for vibrating the strip S of cloth which is gripped and moved by the chuck 114, together with a table 310.

Figure 32A:
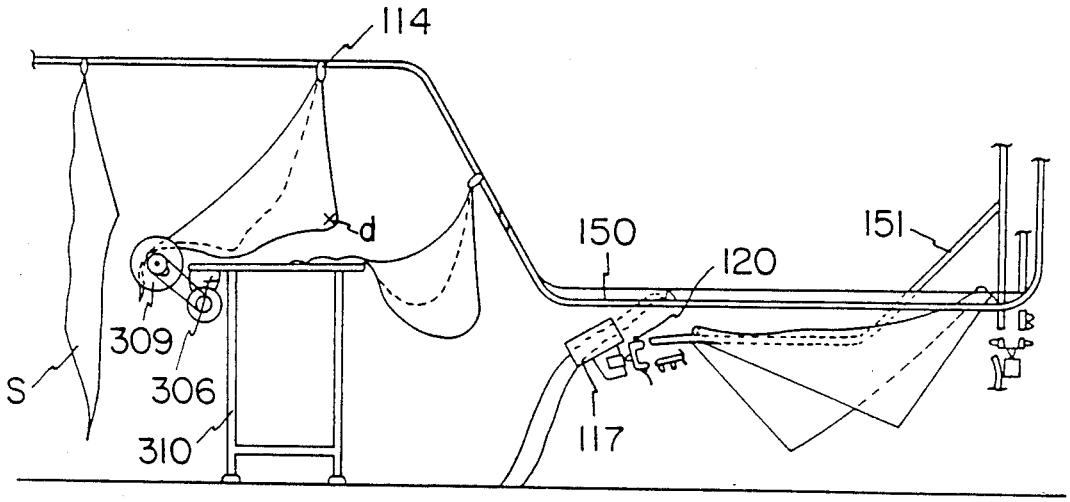
Figure 32B:
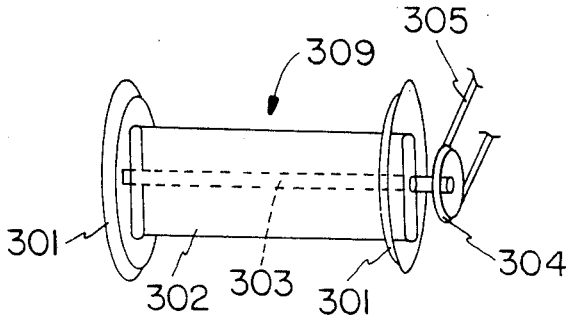
Figure 32C:
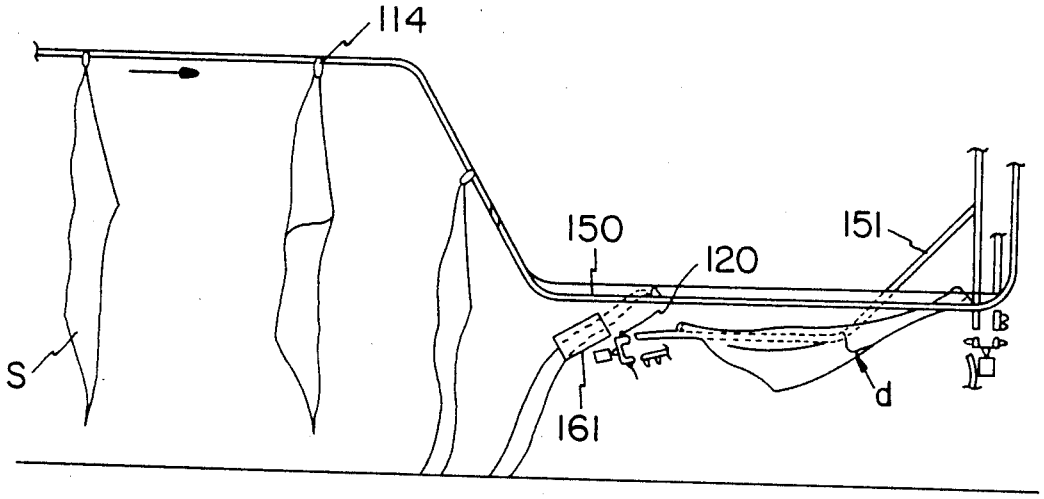

As shown in FIG. 32(*a*), the vibrating roller 309 applies vibrations to the strip S which is gripped and transported by the chuck 114 shown in FIG. 1, to untwist and disentangle a short side of the strip S so that the corner d of the strip S extends below the chuck 114 and in the direction of travel of it. The vibrating roller 309 is usually formed in such a manner that a vibrating plate 302 formed from a stainless steel sheet is rigidly secured to a shaft 303 which rotates at a predetermined number of revolutions, as shown in FIG. 32(*b*). The shaft 303 is rotated by the operation of the drive means 306 through a drive pulley 304 and a chain 305. Accordingly, while the shaft 303 rotates one full turn, the vibrating plate 302 can tap the strip S twice. Since the drive means 306 is connected to a speed controller (not shown), it is possible to select a rate of tapping in accordance with the strip S. The table 310 is disposed at the downstream side of the vibrating roller 309 at the substantially the same height as the vibrating roller 309, to limit the movement of the rear half of the strip S so that the corner d of the strip S disentangled therefrom is prevented from becoming reentangled in the strip S. Conical flanges 301 are respectively attached to both ends of the vibrating roller 309 so that the strip S is prevented from being twisted around the roller 309. It should be noted that the table 310 is usually formed from a stainless steel sheet, and it is also possible to employ a punching plate and round rods which are welded together.

The operation of this embodiment will next be described. Referring to FIG. 32, the chuck 114 gripping the strip S of cloth is transported through the guide rail 150 by means of the chain 138 as shown in FIG. 4. The vibrating roller 309 and the table 310 are located below the guide rail 150, so that the strip S gripped by the chuck 114 is repeatedly tapped by the operation of the vibrating plate 302. Accordingly, even when the strip S is in the form of a mass, it is readily disentangled, and particularly, when the corner d of the short side of the strips S is in contact with the chuck 114, it can be disentangled so as to extend below the chuck 114 and in the direction of its travel.

The operation which takes place in the case where no vibrating roller 309 is provided as shown in FIG. 32(*c*) will now be explained. In this case, the strip S of cloth gripped by the chuck 114 may have the corner [the corner d shown in FIG. 32(*a*)] of a short side thereof entangled in the strip S. In such a case, even if the strip S is squeezed by the squeezing means 117 and the trailing corner portion thereof is gripped, the corner d will not emerge from the strip S in the next step wherein the corner d of the strip S is to be gripped, and therefore it is impossible to grip the corner d.

Results of the test show that such problem occurs at a rate of 30 to 40% and this leads to a considerable lowering in the rate at which the desired corner is successfully gripped. If the vibrating roll is employed, the corner d of the strip S is unfailingly disentangled from the strip S to extend below the chuck 114, and while doing so, the corner d enters the squeezing means 117. Therefore, after the strip S has passed through the squeezing means 117, the corner d of the strip S can be opened infallibly. Accordingly, the chuck 120 in the subsequent chuck conveyor can grip the corner d of the strip S unfailingly.

Since the present invention is arranged as detailed above, it is possible to automate spreading or sorting strips of cloth (linens) which have heretofore been carried out by manual operation. Accordingly, it is possible to relieve operators from a work in the sanitarily inferior environment and to automate the operation in laundry works.

Further, since in the present invention a strip of cloth is squeezed in the squeezing means while being conveyed in a slanted state, the operation is not limited by the dimensions of strips, which provides a practical advantage. Further, in the present invention, while a strip of cloth is being transported, it is untwisted by means of a vibrating roller to disentangle a desired end portion of the strip therefrom, and the strip is then squeezed by a squeezing means. Accordingly, it is possible to achieve a practical advantage that the operation is not limited by the dimensions of strips. It has been experimentally confirmed that the probability of a corner portion of a strip of cloth being successfully gripped can be raised from 50–60% to 90% by disentangling the corner portion of the strip using a combination of the disentangling effect of the vibrating roller and the table.

Although the present invention has been described through specific terms, it should be noted here that the described embodiments are not necessarily limitative and various changes and modifications may be imparted thereto without departing from the scope of the invention which is limited solely by the appended claims.

We claim:

1. A method of gripping corners of a strip of cloth comprising the steps of:

suspending a rectangular strip of cloth by gripping one corner thereof with a chuck;

transporting said chuck by means of a conveyor, and while doing so, applying vibrations to said strip to thereby disentangle a tangled side of said strip;

providing means for squeezing said strip of cloth;

providing a detector for detecting a lowermost corner of said strip of cloth as it is passed through said squeezing means;

providing a plurality of empty chucks;

successively positioning each of said empty chucks at one predetermined set location in proximity to the squeezing means, the thus positioned empty chuck being a second chuck in position to grip said lowermost corner of said strip;

passing said strip through the squeezing means so as to detect a lowermost corner thereof with the detector, wherein a signal is generated by the detector upon detection of the lowermost corner of said strip of cloth; and gripping the detected corner with said second chuck at said one predetermined location in response to said signal.

2. A method of gripping corners of a strip of cloth, comprising the steps of:

gripping one corner of a rectangular strip of cloth with a first chuck and suspending said strip by said gripping corner;

providing means for squeezing said strip of cloth;

providing means for conveying said first chuck so as to convey said strip of cloth through the squeezing means;

providing a detector for detecting a lowermost corner of said strip of cloth as it is conveyed through said squeezing means;

providing a plurality of empty chucks;

successively positioning each of said empty chucks at one predetermined set location in proximity to the squeezing means, the thus positioned empty chuck being a second chuck in position to grip said lowermost corner of said strip;

conveying said first chuck so as to convey said strip of cloth through said squeezing means and detect the lowermost corner of said strip with the detector, wherein a signal is generated by the detector upon detection of the lowermost corner of said strip of cloth;

gripping the detected lowermost corner of said suspended strip with said second chuck at said one predetermined location in response to said signal;

raising one of said gripped corners in a substantially vertical direction to detect a corner of said strip adjacent said gripped corners;

applying a braking force to the other gripped corner to impart tension to said strip;

gripping said adjacent corner of said strip; and releasing either said one corner or said lowermost corner to hold one edge of said rectangular strip substantially horizontal.

3. A method of gripping a corner of a strip of cloth, comprising:

(A) gripping a strip of cloth at any portion thereof with a first chuck;

(B) providing means for squeezing said strip of cloth;

(C) providing means for conveying said first chuck so as to convey said strip of cloth through the squeezing means;

(D) providing a detector for detecting a lowermost corner of said strip of cloth as it is conveyed through said squeezing means;

(E) providing a plurality of empty chucks;

(F) successively positioning each of said empty chucks at one predetermined set location in proximity to the squeezing means, the thus positioned empty chuck being a second chuck in position to grip said lowermost corner of said strip;

(G) conveying said first chuck so as to convey said strip of cloth through said squeezing means and detect the lowermost corner of said strip with the detector, wherein a signal is generated by the detector upon detection of the lowermost portion of said strip of cloth;

(H) closing said second chuck in response to said signal so as to grip the detected lowermost corner of said strip of cloth at said one predetermined set location.

* * * * *